US010837168B2

(12) United States Patent
Rittmanic

(10) Patent No.: US 10,837,168 B2
(45) Date of Patent: Nov. 17, 2020

(54) INTERMODAL CONTAINER BUILDING

(71) Applicant: Matthew Rittmanic, Provo, UT (US)

(72) Inventor: Matthew Rittmanic, Provo, UT (US)

( * ) Notice: Subject to any disclaimer, the term of this patent is extended or adjusted under 35 U.S.C. 154(b) by 245 days.

(21) Appl. No.: 16/087,055

(22) PCT Filed: Mar. 21, 2017

(86) PCT No.: PCT/US2017/023462

§ 371 (c)(1),
(2) Date: Sep. 20, 2018

(87) PCT Pub. No.: WO2017/165455

PCT Pub. Date: Sep. 28, 2017

(65) Prior Publication Data

US 2020/0291637 A1 Sep. 17, 2020

Related U.S. Application Data

(60) Provisional application No. 62/310,886, filed on Mar. 21, 2016.

(51) Int. Cl.
*E04B 1/34* (2006.01)
*E04B 1/348* (2006.01)
(Continued)

(52) U.S. Cl.
CPC ..... *E04B 1/34861* (2013.01); *E04B 1/34321* (2013.01); *E04B 1/34352* (2013.01);
(Continued)

(58) Field of Classification Search
CPC ..... E04B 1/34861; E04B 1/34321; E04B 1/34352; E04B 2001/34884; E04B 2001/34389; E04H 2001/1283
(Continued)

(56) References Cited

U.S. PATENT DOCUMENTS 2,930,880 A * 3/1960 Thompson ..... F24D 13/02 392/352
3,182,424 A 5/1965 Betjemann
(Continued)

FOREIGN PATENT DOCUMENTS

CA 2442403 3/2005
FR 3017406 7/2014
(Continued)

OTHER PUBLICATIONS

PCT International Search Report for PCT International Patent Application No. PCT/US2017/023462, dated Jul. 24, 2017.

*Primary Examiner* — Jeanette E Chapman
(74) *Attorney, Agent, or Firm* — Holland & Hart, LLP

(57) ABSTRACT

A kit for constructing a building may include an intermodal container. The intermodal container may include four exterior walls forming a perimeter of the intermodal container, a floor connected to each of the four exterior walls, and a roof connected to each of the four exterior walls. The four exterior walls, the floor, and the roof collectively define an interior volume of the intermodal container. The kit may also include a plurality of structural building components disposed within the interior volume. When the building is constructed with the structural building components, at least one of the four exterior walls of the intermodal container is repurposed as an interior wall of the building.

13 Claims, 21 Drawing Sheets

(51) Int. Cl.
*E04B 1/343* (2006.01)
*E04H 1/12* (2006.01)

(52) U.S. Cl.
CPC ..... *E04B 2001/34389* (2013.01); *E04B 2001/34884* (2013.01); *E04H 2001/1283* (2013.01)

(58) Field of Classification Search
USPC ..... 52/79.1
See application file for complete search history.

(56) References Cited

U.S. PATENT DOCUMENTS 4,075,814 A 2/1978 Theurer et al.
4,476,089 A * 10/1984 Muller-Frank ..... G21C 1/07 376/381
4,599,829 A * 7/1986 DiMartino, Sr. ..... E04B 1/3483 410/79
4,854,094 A 8/1989 Clark
4,891,919 A 1/1990 Palibroda
5,285,604 A * 2/1994 Carlin ..... B60P 3/14 52/143
5,950,373 A 9/1999 von Hoff et al.
6,125,597 A * 10/2000 Hoffman ..... E02D 27/02 52/169.12
8,484,929 B1 * 7/2013 Begdouri ..... E02D 29/045 52/745.03
9,085,890 B2 7/2015 Strickland et al.
2003/0009954 A1 1/2003 Bradley
2003/0051417 A1 3/2003 Ciotti
2004/0258191 A1 * 12/2004 Aoki ..... B66C 19/02 376/260
2005/0135538 A1 * 6/2005 Aoki ..... G21D 1/02 376/260
2006/0185262 A1 8/2006 Abler
2006/0185264 A1 8/2006 Donahue et al.
2007/0163184 A1 7/2007 Olesch
2009/0159592 A1 * 6/2009 Vitalis ..... B65D 88/126 220/1.5
2009/0223144 A1 9/2009 Leahy
2010/0018131 A1 1/2010 Green
2013/0014450 A1 1/2013 Eposito
2013/0032960 A1 * 2/2013 Russo ..... B29C 48/28 264/40.5
2015/0152634 A1 6/2015 Unger
2015/0357063 A1 * 12/2015 Sato ..... G21C 9/004 376/309
2019/0141859 A1 * 5/2019 LeFebvre ..... H05K 7/20836

FOREIGN PATENT DOCUMENTS

GB 2420126 5/2006
JP 02201297 A * 8/1990 ..... G21F 1/125

* cited by examiner

INTERMODAL CONTAINER BUILDING

BACKGROUND

Due to trade imbalances, intermodal containers are plentiful in some countries of the world. Thus, a need exists to recycle or repurpose these intermodal containers. The abundance of these intermodal containers have led some to turn them into habitable structures. Examples of some of the modifications made to the intermodal containers to make them habitable include cutting holes in intermodal containers and installing windows and doors in the container's outer skin. Further, some have modified the intermodal containers to create a structure with pivotal or mobile panels that allow the panels to fold out to expand the structure during on-site installation. In some cases, multiple units are stacked in various configurations to increase the usable floor area. Some of the modifications that have been made to the intermodal containers compromise the container's integrity so that the container no longer complies with the International Standard Organization (ISO) thereby preventing the containers to be shipped individually, or with contents, using standard forms of intermodal transport over air, land and sea. Additionally, other design of onsite expansion compromise the structural integrity and strength of the container type structure used in transport. Other modifications to the intermodal containers require onsite mechanized equipment, local availability of construction materials and skilled labor to assemble the structure once the intermodal container and the other supplies are delivered to the construction site. The requirement local materials and skilled labor inherently restricts distribution because of limitations imposed by availability of materials and competent craftsman and increases the costs of erecting the building structure, which may make the purchase of an intermodal container based housing structure cost prohibitive to a lower socioeconomic class of people.

One type of containerized housing structure is disclosed in U.S. Patent Application No. 2013/0014450 issued to Joseph Esposito. In this reference, the invention includes a self-contained structure configurable as a shipping container and as a dwelling is provided. The self-contained structure configurable as a shipping container and as a dwelling includes a lower section including a platform and a floor, said lower section forming a first portion of a foundation of said dwelling; an upper section including a ceiling and connected to the lower section to define a cavity, said upper section forming a first portion of a roof of said dwelling; a plurality of wall components attached to said lower section and said upper section within said cavity to form subcavities within said cavity; a plurality of panels attachable to said lower section and said upper section to enclose said cavity when the structure is configured as the shipping container and attachable to said upper section to form a second portion of said roof of said dwelling extending from said first portion of said roof to define an approximate area of said dwelling when the structure is configured as the dwelling; and a plurality of extension walls storable within said subcavities when the structure is configured as the shipping container and configurable to enclose said approximate area of said dwelling when the structure is configured as the dwelling. Structures like those disclosed in this reference seem to require on-site foundation materials and labor with a high level of skill.

Another type of container structure is disclosed in U.S. Pat. No. 9,085,890 issued to Joseph Strickland. In this reference, a method is disclosed for rapidly deploying and erecting a HUD-certified structure includes providing an ISO-certified container. The container includes a container frame including a horizontal floor section, an opposed horizontal roof section and first and second opposed vertical end sections, and a pair of opposed vertically-disposed floor panels. The container frame and the opposed floor panels define an interior cavity with a plurality of dwelling members disposed therein. The method further includes transporting the ISO-certified container to a desired location and forming a HUD-certified structure at the desired location, including manipulating at least some of the dwelling members. An example disclosed in this reference includes a container like structure with a fold out wall system that allows included roof panels to be installed. The structure seems designed for rapid and temporary deployment, as no permanent foundation is included in the design and the insulation and long-term integrity of the building envelope does not appear to provide for long term exposure and occupancy.

DISCLOSURE OF THE INVENTION

In one embodiment, a kit for constructing a building includes an intermodal container. The intermodal container includes four exterior walls forming a perimeter of the intermodal container, a floor connected to each of the four exterior walls and a roof connected to each of the four exterior walls. The four exterior walls, the floor, and the roof collectively define an interior volume of the intermodal container. a plurality of structural building components are disposed within the interior volume. When the building is constructed with the structural building components, at least one of the four exterior walls of the intermodal container is repurposed as an interior wall of the building.

The structural building components may include all the structural elements necessary to construct the building.

The structural building components may include detachable walls that form exterior building walls when the building is constructed.

The plurality of structural building components may include at least one foundation pile.

The plurality of structural building components may include an adjustable pile foundation system.

The kit may include a pre-wired base board.

In one embodiment, a packaged intermodal container may include four exterior walls forming a perimeter of the intermodal container, a floor connected to each of the four exterior walls, a roof connected to each of the four exterior walls, the four exterior walls, the floor, and the roof collectively forming an interior volume of the container, and all the structural elements necessary to construct a building disposed within the interior volume. When building is constructed with the structural elements, at least one of the four exterior walls is repurposed as an interior wall of the building.

All the tools necessary for constructing the building may be disposed within the interior volume.

When the building is constructed, at least one of the exterior walls may be repurposed as interior walls of the building.

The intermodal container may be repurposed as part of the building.

The intermodal container may form one of multiple rooms of the building.

The intermodal container may be a safety pod having the characteristic of greater stability to withstand a force of nature than other rooms in the building.

In one embodiment, a baseboard may include a baseboard material, a pre-fold formed in the baseboard material, a wire embedded in the baseboard material and traversing the pre-fold, and an electrical outlet incorporated into the baseboard material and in communication with the wire.

The baseboard material may include a first portion of a snap connection.

The baseboard may include a second portion of the snap connection is incorporated into a wall, and the baseboard material is constructed to snap into the wall through when the first portion of the snap connection is secured to the second portion of the snap connection.

The baseboard may include a first electrical connector in communication with the wire.

The first electrical connector may be configured to connect to a second electrical connector incorporated into the wall.

In one embodiment, a building may include a wall, a baseboard selectively removable from the wall, a pre-fold formed in the baseboard, a wire embedded in the baseboard and traversing the pre-fold, and an electrical outlet incorporated into the baseboard and in communication with the wire.

The building may include a connector attached to the wall. The baseboard may be detachably connected to the wall through the connector.

The connector may be a clip.

The building may include a board electrical connector in communication with the wire.

The building may include a wall electrical connector incorporated into the wall. The wall electrical connector and the board electrical connector form an electrical connection when the wall electrical connector and the board electrical connector are attached.

The building may include a solar energy source in electrical contact with the wall electrical connector.

The solar energy sources may include a solar panel.

In one embodiment, a foundation system in a building includes an adjustable pile. The adjustable pile may include a footing and a pipe connected to the footing. The pipe may include a stationary portion and a height adjustable portion movably connected to the stationary portion.

The stationary portion may include an internal threaded rod.

The height adjustable portion may include an outer sheath.

The internal threaded rod may be disposed within the outer sheath where the internal threaded rod and the thread form of the outer sheath are intermeshed.

The stationary portion may be rotationally fixed with respect to the footing, and the height adjustable portion may be rotatably movable with respect to the footing.

The adjustable pile may lengthen when the outer sheath is rotated in a first direction with respect to the stationary portion, and the adjustable pile may shorten when the height adjustable portion is rotated in a second direction with respect to the stationary portion where the second direction is opposite the first direction.

The height adjustable portion may include an outer surface and a wrench flat formed in the outer surface.

The height adjustable portion may include an attachment to a building structure.

In one embodiment, a building may include a building structure and an adjustable pile. The adjustable pile may include a footing and a pipe connected to the footing. The pipe may include a stationary portion and a height adjustable portion movable with respect to the stationary portion.

The stationary portion may be rotationally fixed with respect to the footing and the height adjustable portion may be rotatably movable with respect to the footing.

The adjustable pile may lengthens when the height adjustable portion is rotated in a first direction with respect to the stationary portion and the adjustable pile may shorten when the height adjustable portion is rotated in a second direction with respect to the stationary portion where the second direction is opposite the first direction.

The height adjustable portion may include an outer surface and a wrench flat formed in the outer surface.

The height adjustable portion may include an attachment to the building structure.

The building structure may include a repurposed intermodal container, and the height adjustable portion is connected to the intermodal container.

The intermodal container may include a corner fitting, and the height adjustable portion is connected to the corner fitting.

The height adjustable portion may include a twist lock device that selectively locks into the corner fitting.

The intermodal container may include an bottom edge, a first corner of the bottom edge, a second corner of the bottom edge, and a mid-region located between the first corner and the second corner along the bottom edge. The height adjustable portion is connected to the intermodal container within the mid-region.

The building structure may be a floor beam.

The height adjustable portion may be a twist lock device that selectively locks into the floor beam.

The stationary portion may include an internal threaded rod and the height adjustable portion includes an outer sheath. The outer sheath may include an internal thread form that is intermeshed with the internal threaded rod.

In one embodiment, a method for constructing a building includes placing a footing of an adjustable pile in a hole, adjusting the height of the adjustable pile by rotating an outer sheath of the pile, and locking an end of the outer sheath into a fitting of a repurposed intermodal container.

In one embodiment, a building includes a repurposed intermodal container, a roof structure attached to the repurposed intermodal container, a gutter connected to a lower edge of the roof structure, and a drain connected to the gutter that diverts water from the roof structure to a ground cistern located underneath the repurposed intermodal container.

The building may include a roof water cistern located between the roof structure and the intermodal container.

The building may include a conduit from the ground cistern to the roof cistern and a pump that directs water from the ground cistern to the roof cistern when activated.

The pump may be a manually operated pump.

The building may include a faucet located beneath the roof cistern and a distribution channel connecting the faucet and the roof cistern. When water is in the distribution channel, gravity may pressurize the water providing a force to expel water from the faucet when the faucet is open.

In one embodiment, a building may include a wall. The wall may include a first wall panel, and additional wall panels aligned with and adjacent to the first wall panel, a first opening defined along a first length of the additional wall panels, a second opening defined along a length of the additional wall panels, a wall rod partially disposed within the first opening and partially disposed in the additional openings, and a compression mechanism that applies a first compression load along the first length and the additional lengths through the wall rod causing the first wall panel and the additional wall panels to be held together through compression.

The compression mechanism may include a rod end of the wall rod and a thread form formed in the rod end. The first compression load may increase between the first wall panel and the second wall panel as the wall rod is rotated in a first direction.

The building may include a complementary thread form formed in the second opening.

The second wall panel may be a side of an intermodal container.

The building may include an intermodal container, a screw hole defined in the intermodal container. and the rod end is threadedly connected to the intermodal container at the screw hole. The first wall panel and the second wall panel may be compressively held against the intermodal container through the compressive load applied through the wall rod.

The building may include a roof. The roof may include a first roof panel, a second roof panel aligned with and adjacent to the first roof panel, and a first roof rod compressively holding the first roof panel and the second roof panel together.

The roof rod may be aligned with the wall rod and the roof rod is connected to the wall rod through a synching mechanism.

The synching mechanism may include a turnbuckle fastener.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Further, for the purposes of this disclosure the term "intermodal container" generally means a standardized container built for intermodal freight transport so that the containers can be used across different modes of transport (e.g. shipping, trucking, and rail) without unloading and reloading their cargo. These containers may meet the standards set forth by the International Standards Organization (ISO), but not necessarily in all cases. Within the standards set forth by the ISO, the intermodal containers can have different lengths, heights, widths, weights, load ratings, varying materials, and other varying characteristics.

Figure 1:
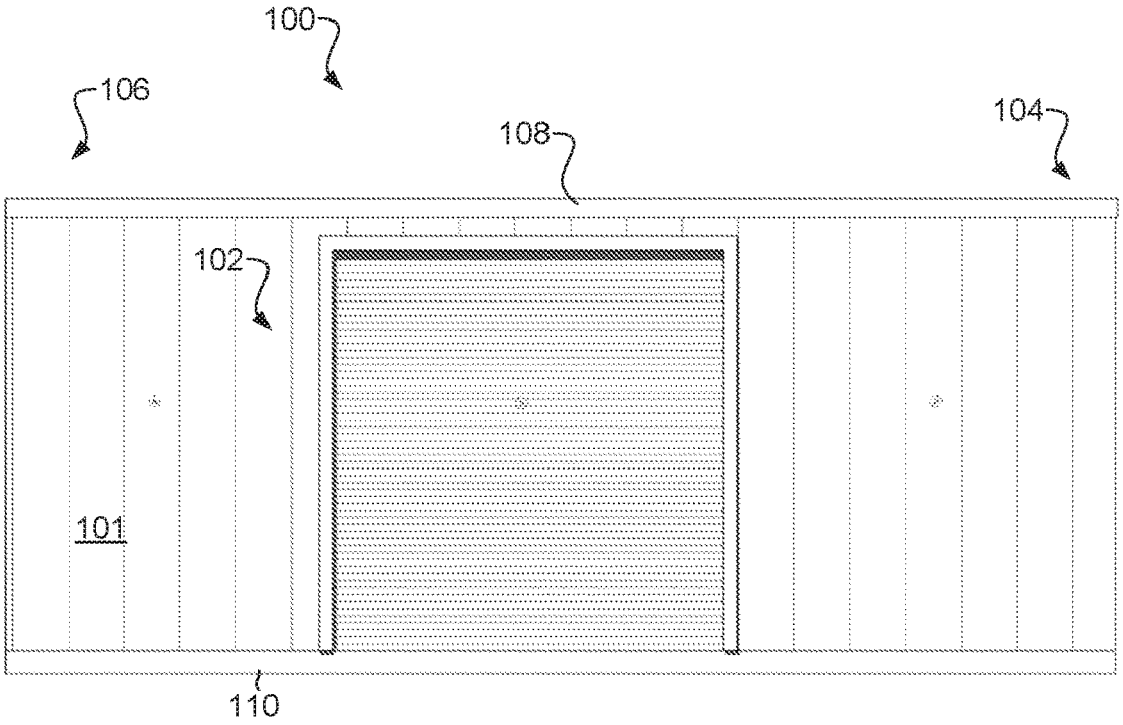
FIG. 1 depicts an example of a shipping container in accordance with the principles described in the present disclosure.
Figure 2:
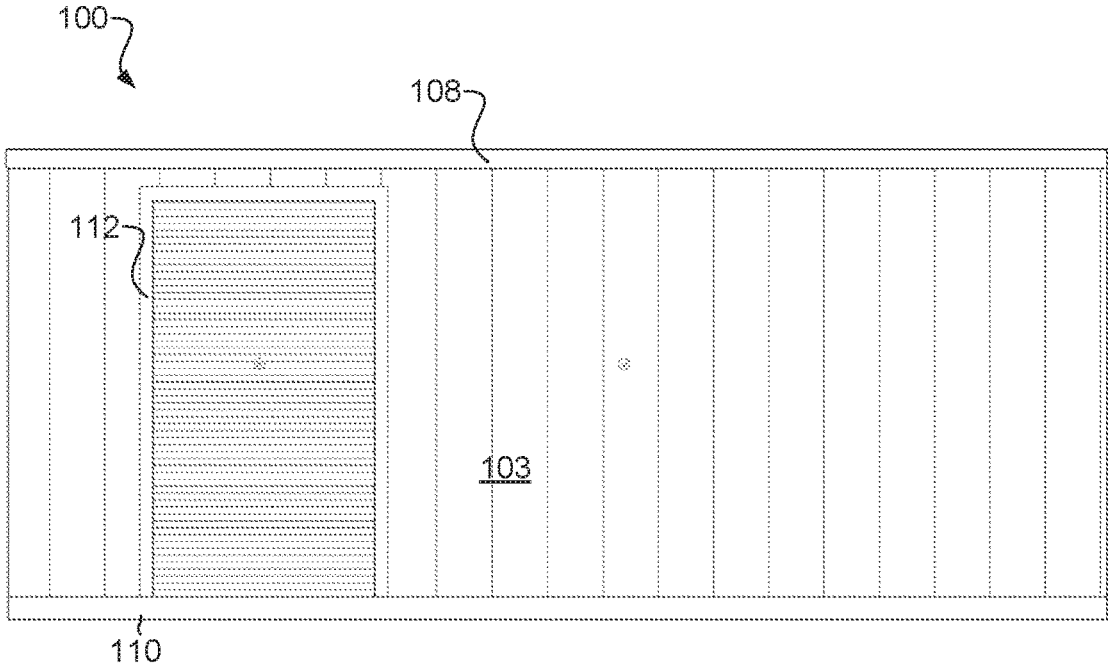
FIG. 2 depicts an example of a shipping container in accordance with the principles described in the present disclosure.

FIGS. 1 and 2 depict an example of a shipping container 100 that may be modified with openings engineered to retain the ISO certification that houses the materials for constructing a building. The building may be any appropriate type of building such as a home, an office building, a pharmacy, or another type of building, or combinations thereof. In some examples, the shipping container 100 has been modified to be part of the building when the building is finished. Thus, the constructed building will includes shipping container that forms at least one room, where the shipping container retains the ISO certification. In some examples, all the materials and tools for constructing this building are contained within the shipping container 100 or are part of the shipping container.

In the example of FIG. 1, the shipping container 100 includes a door 102 defined in a first side 101 of the shipping container 100. The first side 101 is opposite a second side 103 of the shipping container 100. The first and second sides 101 and 103 are connected by third side 104, and a fourth side 106 also connects the first and second sides 101 and 103 of the shipping container 100. The fourth side 106 is opposite and aligned with the third side 104. The first, second, third, and fourth sides 101, 103, 104, 106 are connected at the top by a top side 108 of the shipping container. Also, the first, second, third, and fourth sides 101, 103, 104, 106 are connected at the bottom by a bottom side 110. The bottom side 110 is opposite and generally aligned with the top side 108.

The first side 101 of the shipping container 100 may include a first door 102, and the second side 103 of the shipping container 100 may include a second door 112. Each of the first and second doors 102, 112 may be cut out of the shipping container's walls prior to shipping. For example, the doors 102, 112 may be cut out of the walls during the manufacturing process. After the doors have been formed, the shipping container may be filled with other materials for shipping to the construction site. While this example has been described with the doors being cut out at the manufacturing facility, in some examples the shipping container walls are unmodified prior to shipping. In those examples, the container may be used as part of the building where the doors are formed after arrival at the construction site. Alternatively, doors may not be cut out at all in the shipping container 100. In this example, the building may not include doors formed in the walls of the shipping container. In some examples, more or fewer doors are formed and the sides of the shipping container. For example, the first side may include a door, and the second side of the shipping container may include a door. In another example, one of the first side or the second side of the shipping container may include multiple doors and/or no doors.

In some examples, the cut outs for the door may be reinforced with a frame 105. The frame 105 may be formed of any appropriate type of material. In some examples, the frame is a metal frame. The frame may protect individuals from sharp edges resulting from the cut out process. In some cases, at least one of the doors roll up when opening. In some of these examples, the slats of the door may be guided by the door frame and the slats of the door may slide on tracks and open along the top of the container or rotate around and axle positioned near the top side of the shipping container.

Figure 3:
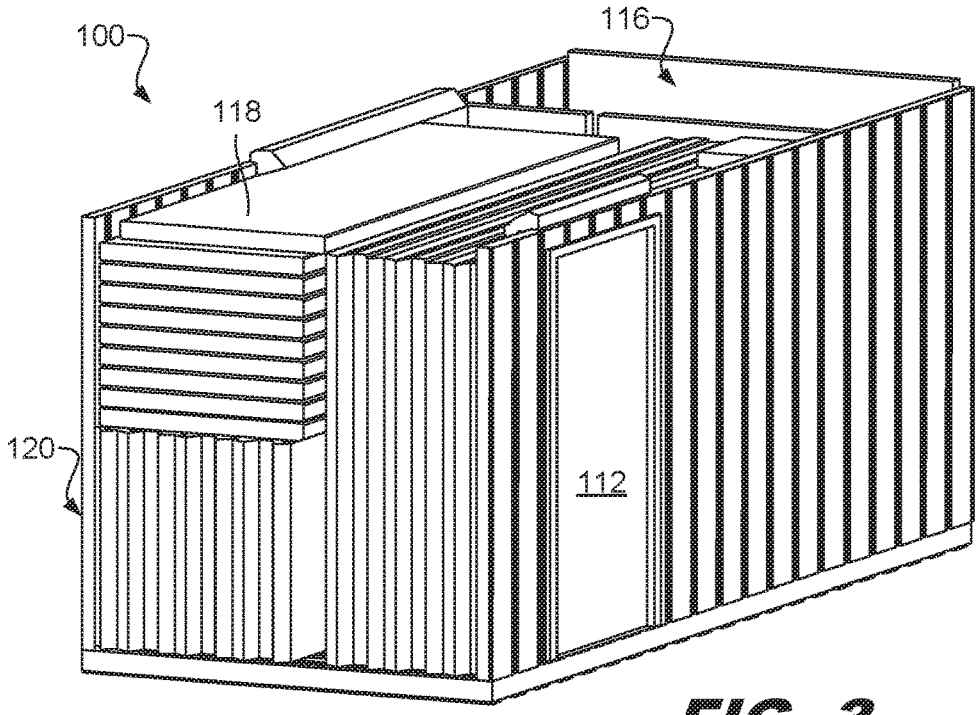
FIG. 3 depicts an example of a shipping container in accordance with the principles described in the present disclosure.
Figure 4:
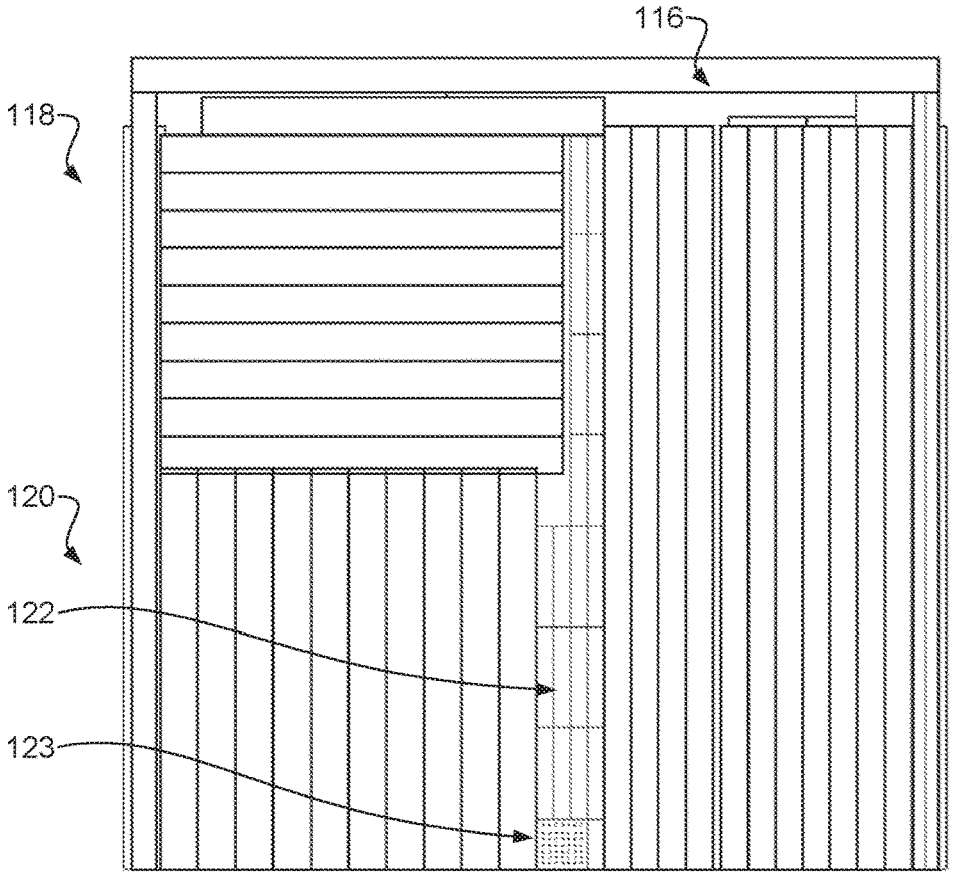
FIG. 4 depicts an example of a shipping container in accordance with the principles described in the present disclosure.

FIGS. 3 and 4 depict an example of the shipping container 100 with some of the sides removed to illustrate an example of how the shipping container may be arranged to hold materials for building a structure. In this example, the container includes wall panels 116, floor panels 118, and roof beams and panels 120. Additionally, the shipping container may also include beams 122 and rods 123 that may be used in the construction of the building. In some cases, the beams may be fitted between some of the panels within the container during transport. Any appropriate type of beam may be used for the building's construction. For example, a non-exhaustive list of types of beams may include metal beams, composite beams, engineered beams, other types of beams, or combinations thereof. In some cases, the rods are threaded at their ends. In some cases, the threaded rods are used to connect the panels to each other during the construction process.

Figure 5:
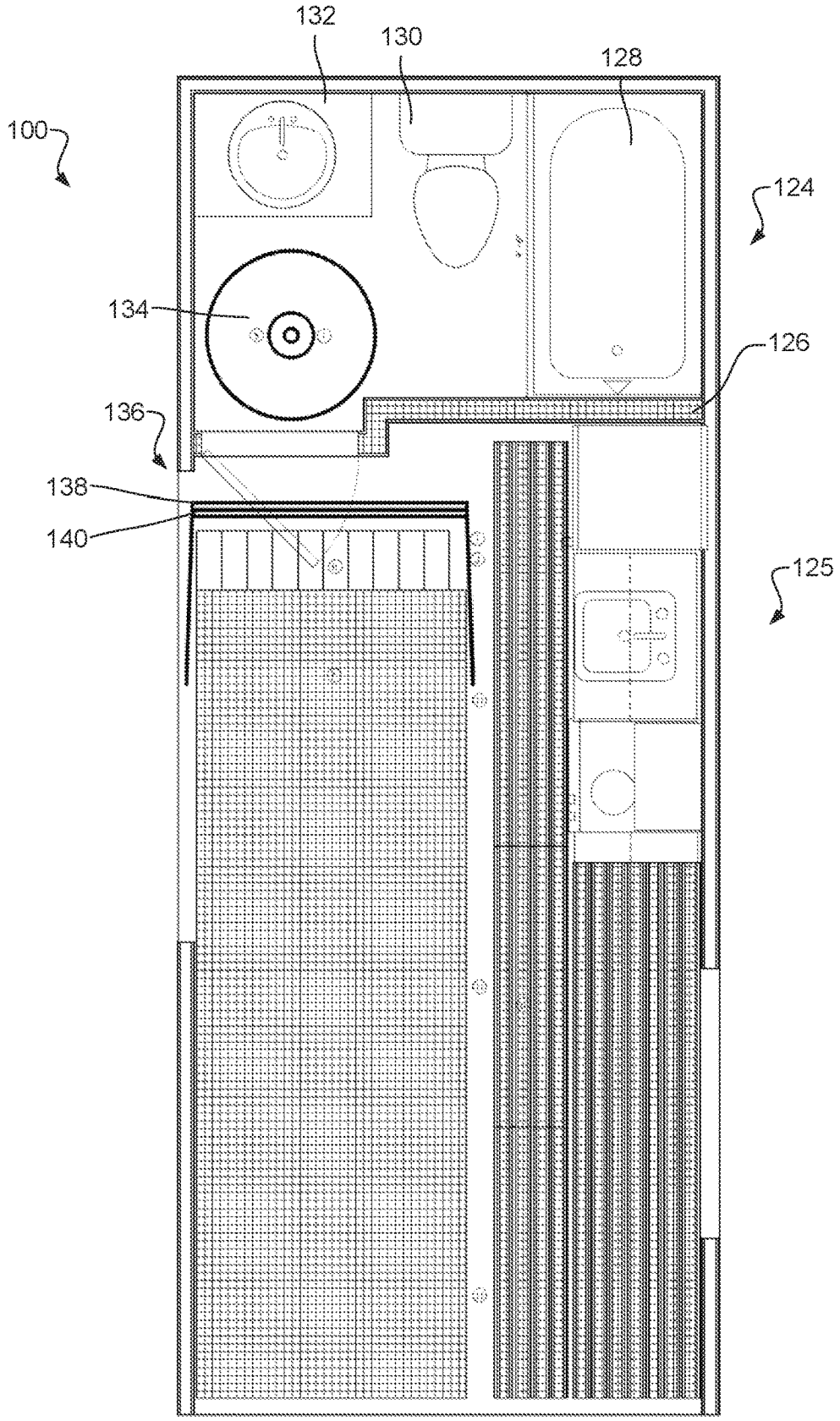
FIG. 5 depicts an example of a shipping container in accordance with the principles described in the present disclosure.

FIG. 5 depicts an example of the shipping container 100 with multiple building components contained therein. In this example, a first portion of the shipping container is filled with panels and other materials for building the structure. Some of the appliances intended to be used in the building after construction may be pre-installed within the shipping container. For example, in the illustrated figure a kitchen area 125 and a bathroom area 124 have components that are already pre-installed. In the kitchen area, a kitchen sink 127 is pre-installed along with some other appliances that can be used in the kitchen, such as an oven. In the bathroom area, a bathtub 128, a toilet 130, sink 132, other bathroom components, or combinations thereof may be pre-installed prior to transporting the shipping container 100. The kitchen area 125 and the bathroom area 124 may be separated by an existing wall 126. The existing wall may incorporate a bathroom door 136. Also, stored in the bathroom area 124 may be other components that may be useful for constructing the building on-site. In this example, foundation footings 134 are stored in the bathroom area 124. An upper cistern 138, an additional buried liquid basins are also stored in the shipping container. In some cases, the additional liquid basins may include a septic tank, another cistern, or combinations thereof. In the depicted example, the cistern 138 and the other liquid basin 140 are nested together to save space within the shipping container's volume.

Figure 6:
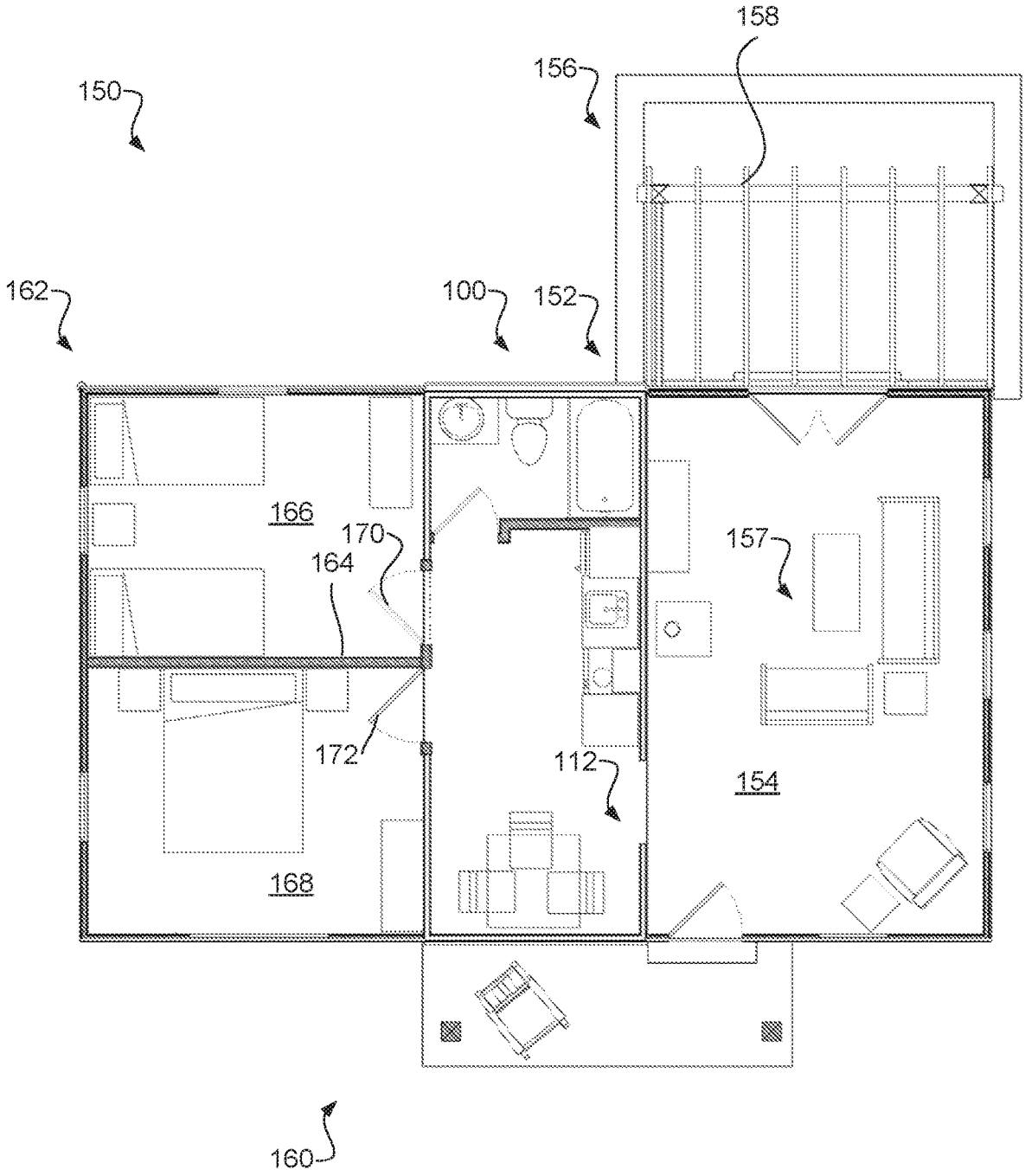
FIG. 6 depicts an example of a constructed building in accordance with the principles described in the present disclosure.
Figure 7:
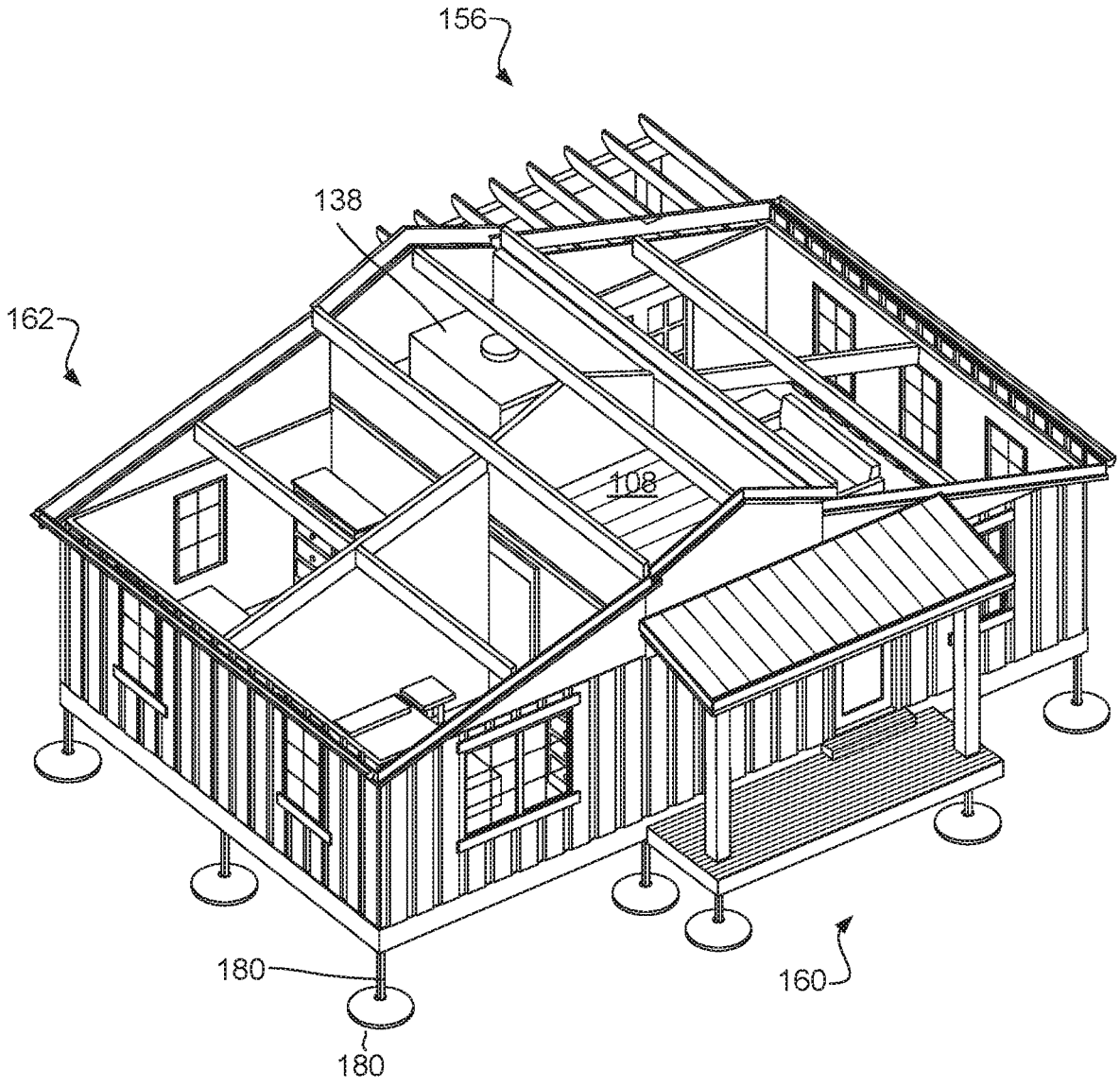
FIG. 7 depicts an example of a constructed building in accordance with the principles described in the present disclosure.
Figure 8:
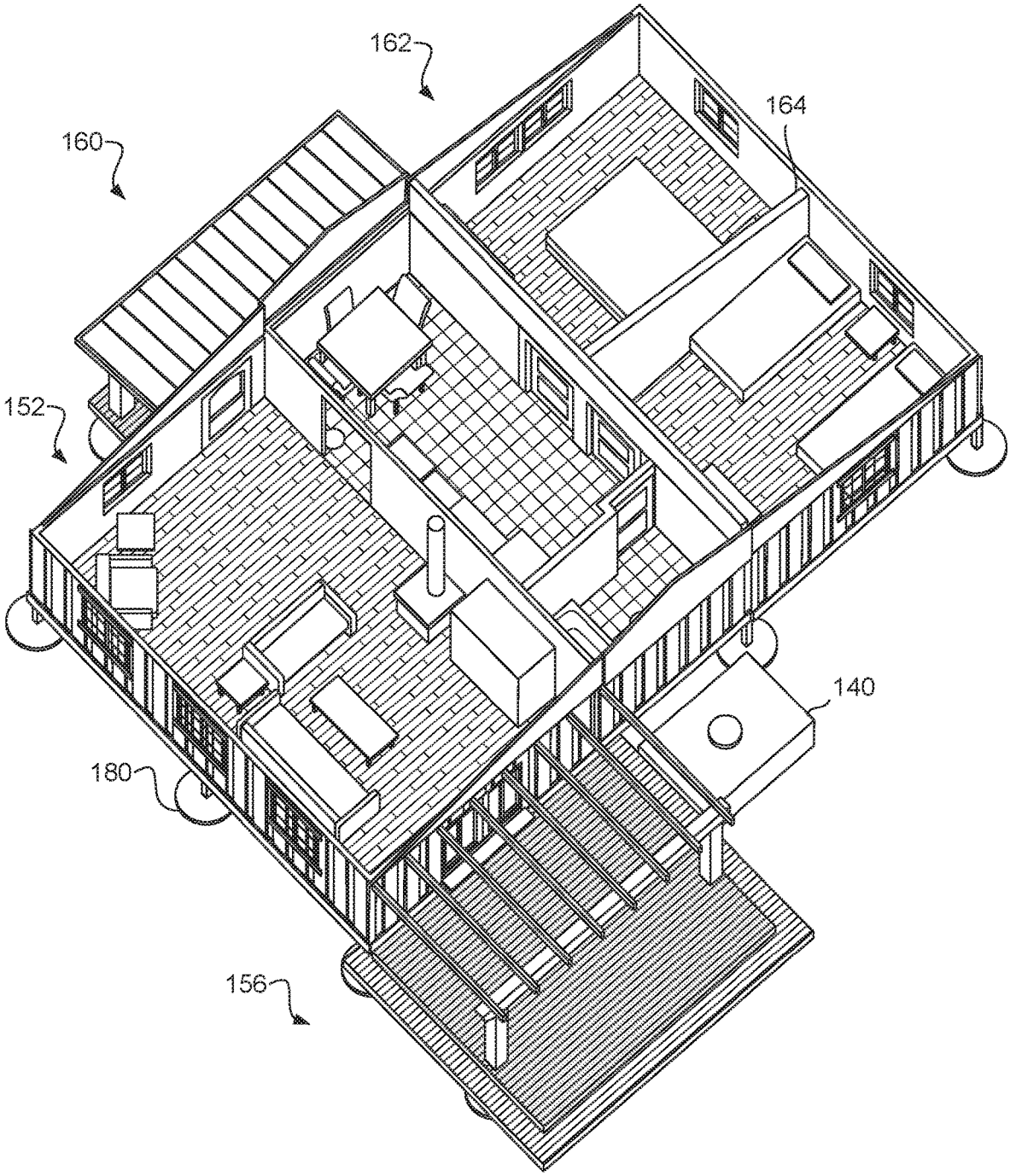
FIG. 8 depicts an example of a constructed building in accordance with the principles described in the present disclosure.
Figure 9:
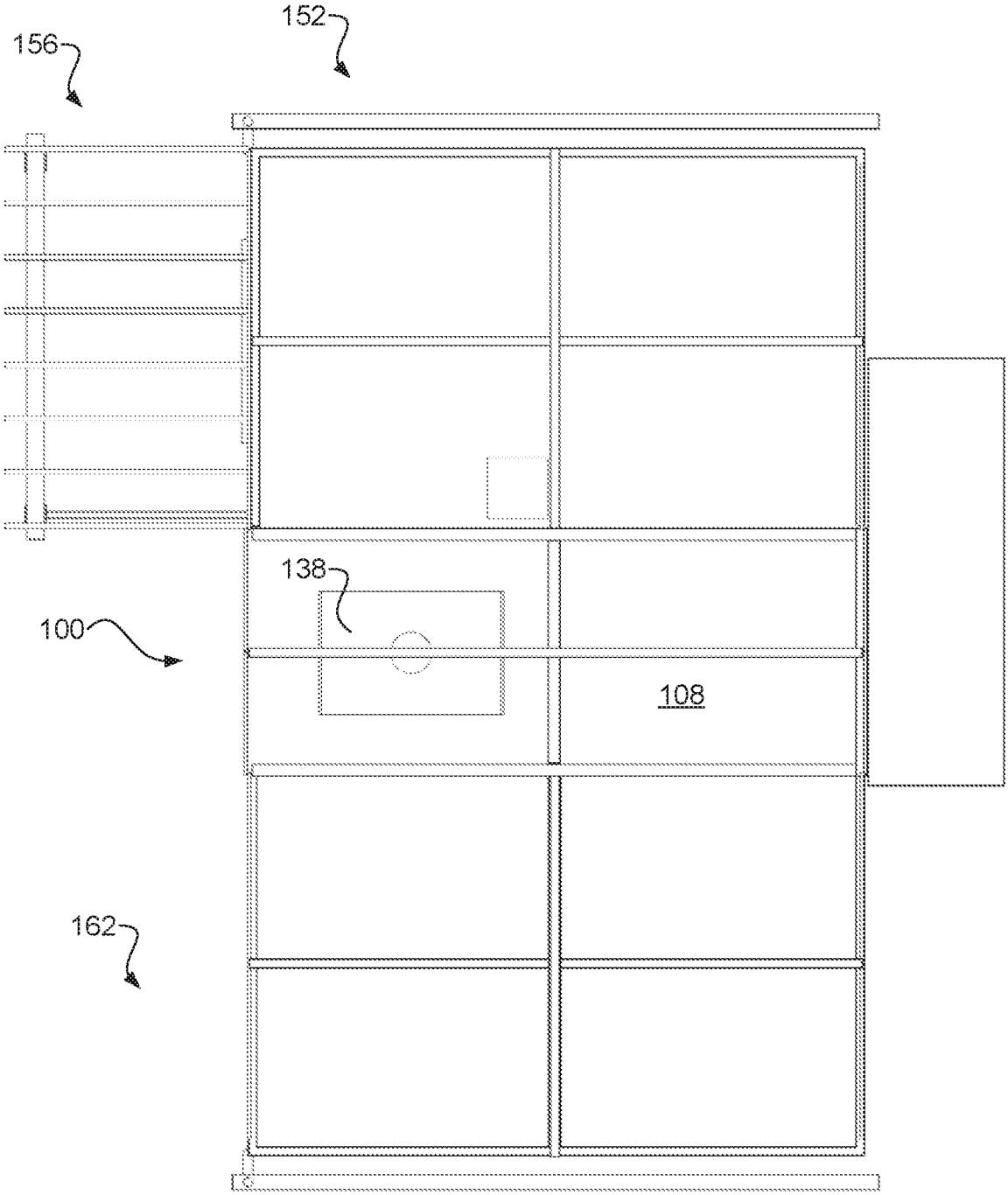
FIG. 9 depicts an example of a constructed building in accordance with the principles described in the present disclosure.

FIGS. 6-9 depict various examples of the building after construction on site. FIG. 6 depicts a schematic of the constructed building 150 from top view. FIG. 7 depicts an example of the building showing the shipping container 100 fully encompassed within the wall and floor panels 116, 118. FIG. 8 depicts a top perspective view of the constructed building 150 with the roof panel removed and the top side of the shipping container removed. FIG. 9 depicts a schematic of the constructed building 150 showing the roof beams 120 and the top side 108 of shipping container 100.

The shipping container may form a central room of the building. In some examples, the container may be a safety pod that is capable of withstanding earthquakes, hurricanes, and other types of natural disasters. In some cases, the safety pod can also be a vandalism resistant room within the structure. The safety part may hinder theft or hinder crimes being committed against the occupants of the building due to its structural stability.

The materials stored within and shipped within the shipping container 100 may be used to add extensions onto the building. A first extension 152 may include a living room 154 and furniture 157. The second door 112 of the shipping container 100 may provide access from the shipping container 100 to the living room. The furniture that is within depicted within the living room may be furniture that was shipped and stored within the shipping container 100. Attached to the living room 154, in this example, is a back deck 156 that is covered by a pergola 158. In other types of examples, a different type of structure may be used to provide shade. On the opposite side of the living room 154, a front porch 160 may be built into the structure. A second extension 162 may be on the opposite side of the shipping container 100 and may provide multiple rooms. A separating wall 164 may separate the second extension into a first room 166 and a second room 168. In some examples, the second extension 162 include the first bedroom and a second bedroom. The separating wall 164 may provide may bifurcate the original first door (FIG. 1, 104) of the shipping container 100. This may allow the first door to be separated into a first bedroom door 170 and a second bedroom door 172. The beds, nightstands, chest of drawers, or other types of bedroom furniture may also have been stored in the shipping container originally.

Footings 180 may be buried under the ground to provide a stable platform on which to construct the building. Piles 182 may connect the foundation footings 180 to the floor panels of the building. A cistern 138 may be positioned on top of the top side 108 of the shipping container 100. As water is collected from the roof during a rainstorm or supplemented, the water may be collected into the buried cistern 140 and pumped into an upper cistern 138 for distribution. The cistern 138 may be stored overhead so that gravity may be used to direct water to faucets/or pipes that are incorporated into the building, which may allow the building to provide running water to occupants. The septic tank 140 may be buried underground also and provide a place for waste materials to be collected.

Figure 10:
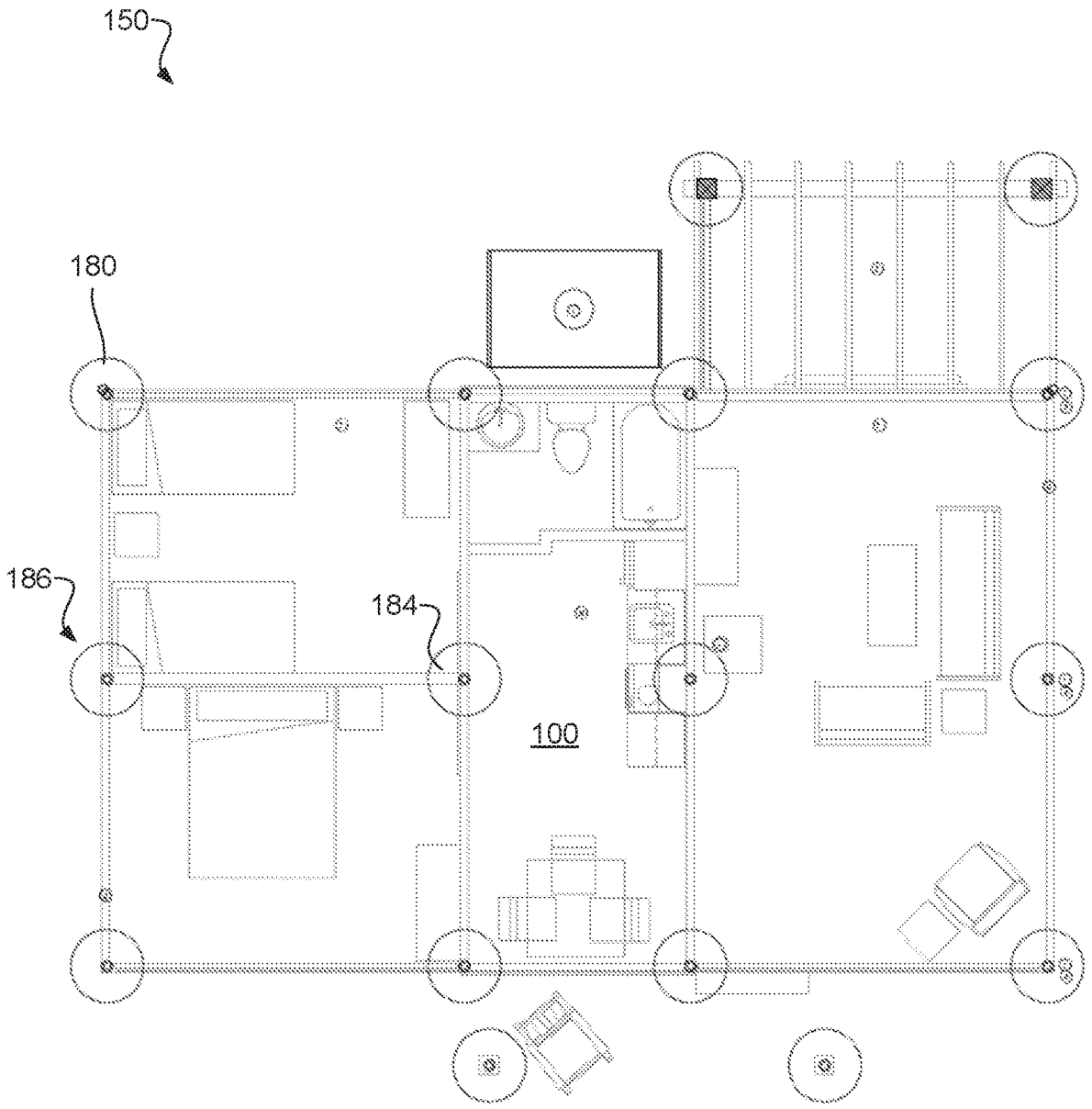
FIG. 10 depicts an example of a constructed building in accordance with the principles described in the present disclosure.

FIG. 10 depicts an example of an underside of the constructed building 150. This example, at least some of the footings 180 that may be incorporated into the building are depicted. In this example, footings 180 are buried beneath the structure at locations that would provide structural stability to the floor panels and beams of the constructed building 150. In the depicted example, a footing is positioned at each of the corners of the shipping container 100 as well as the midpoints 184 of the sides of the shipping container.

Footings 180 are also positioned at the corners of the first and second extensions as well as the midpoints 186 of the outer wall of the extensions. A transverse floor beam 188 runs from the footing positioned at the midpoint of the shipping container to the midpoint of the wall of the first extension. Additionally, footings may be positioned at the corners of the back deck and also corners of the front porch.

Figure 11:
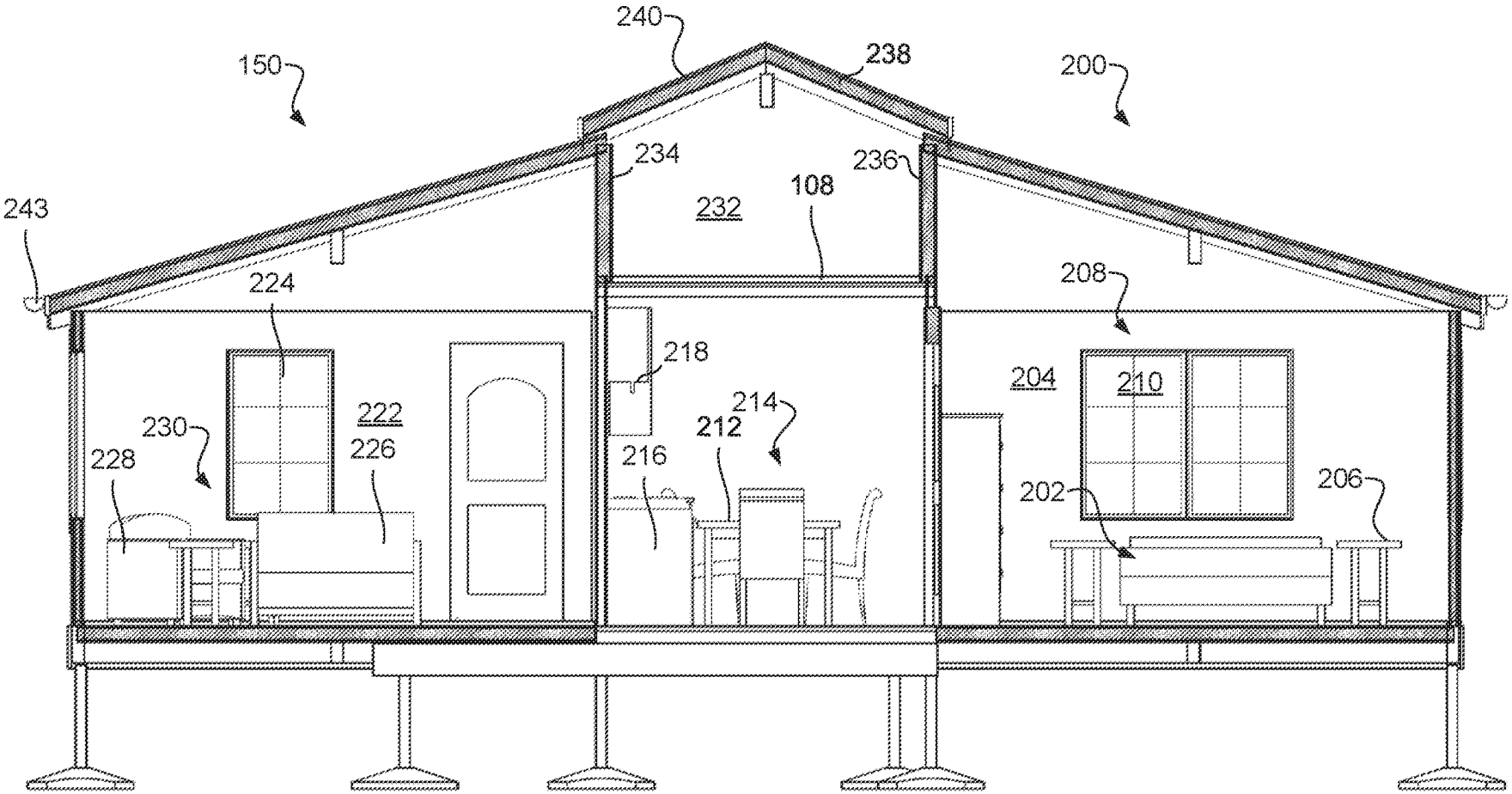
FIG. 11 depicts an example of a constructed building in accordance with the principles described in the present disclosure.

FIG. 11 depicts a cross-sectional view of an example of the constructed building 150. In this example, an extension 200 includes a bed 202 in a bedroom 204 with nightstands 206. The bedroom 204 also includes a window cutout 208 in the prefabricated wall where the window space was cut out prior to shipping and the window 210 is installed at the construction site. The bedroom 204 also included chest of drawers. The bedroom 204 is supported by a plurality of footings attached piles. The piles are connected to the wall panels.

In this example, the room defined by the shipping container 100 is centrally located in the constructed building 150. The shipping container is also supported by a plurality of footings connected to piles connected into the underside of the shipping container. Some examples the pile may be connected to the side of the shipping container. The room defined by shipping container is depicted as having a table 212 and chairs 214 well as an oven 216 and cabinets 218 hung only shipping container walls. A second extension 220 opposite to the first extension 200 with the bedrooms contains a living room 222. This living room 222 is depicted with another window cutout 224. This living room 222 is also depicted with a couch 226, a reading chair 228, and a coffee table 230.

An attic area 232 is depicted above the top side 108 of the shipping container 100. Prefabricated wall panels 234, 236 may distance the roof panels 238, 240 from the top side 108 of the shipping container 100. Rain gutters 243 may be attached to the sides of the roof and can be used to direct water to the cistern connected to the roof.

Figure 12:
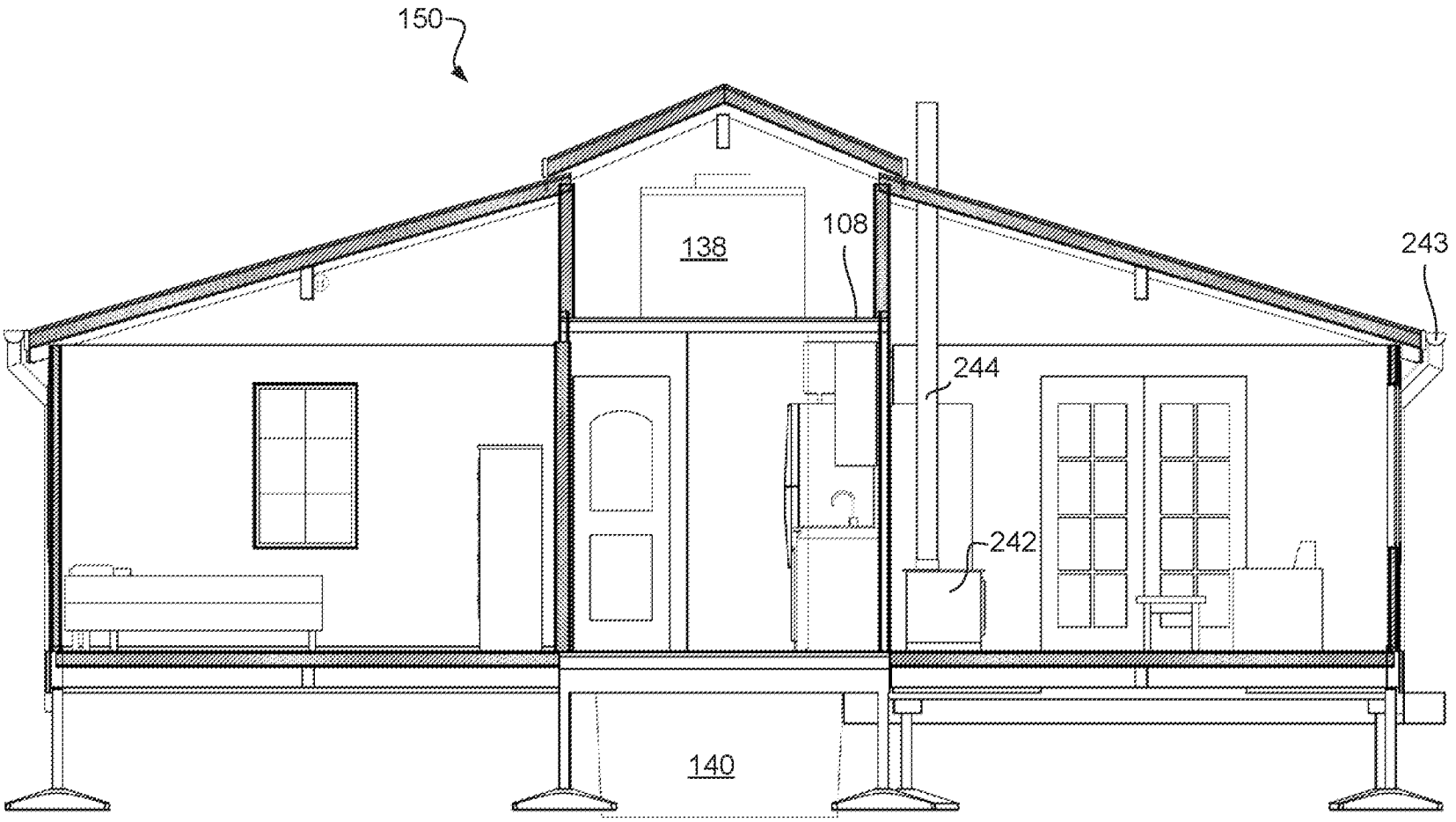
FIG. 12 depicts an example of a constructed building in accordance with the principles described in the present disclosure.

FIG. 12 also depicts an example of a cross-section of the constructed building 150. In this example, the constructed building 150 is facing an opposite side than is depicted in FIG. 11. In this example, a stove 242 is depicted in the living room. The stove 242 may be wood burning stove or another appropriate type of stove. A chimney 244 connects the stove 242 to the outside of the constructed building and can direct smoke out of the building structure. The chimney 244 may be inserted through an opening prefabricated or formed on-site in at least one of the roof panels.

In this example, the cistern 138 is depicted on top of the top side 108 of the shipping container 100. In some examples, rain gutters 243 may be slightly higher than the bottom of the cistern 138 to collect rain water. In some cases, the rain gutters 143 are higher than the cistern 138 and water can flow directly into the cistern 138. In another example, a pump may be used to move pooled water from a rainstorm into the cistern 138.

In some embodiments, the septic tank 140 is beneath the shipping container 100. In some examples, the elevation of the septic tank 140 is lower than the elevation of the shipping container 100, but the septic tank 140 is positioned and graded away from the outside underside of the shipping container 100. In this example, the septic tank 140 can be accessed without having to go underneath the shipping container 100.

Figure 13:
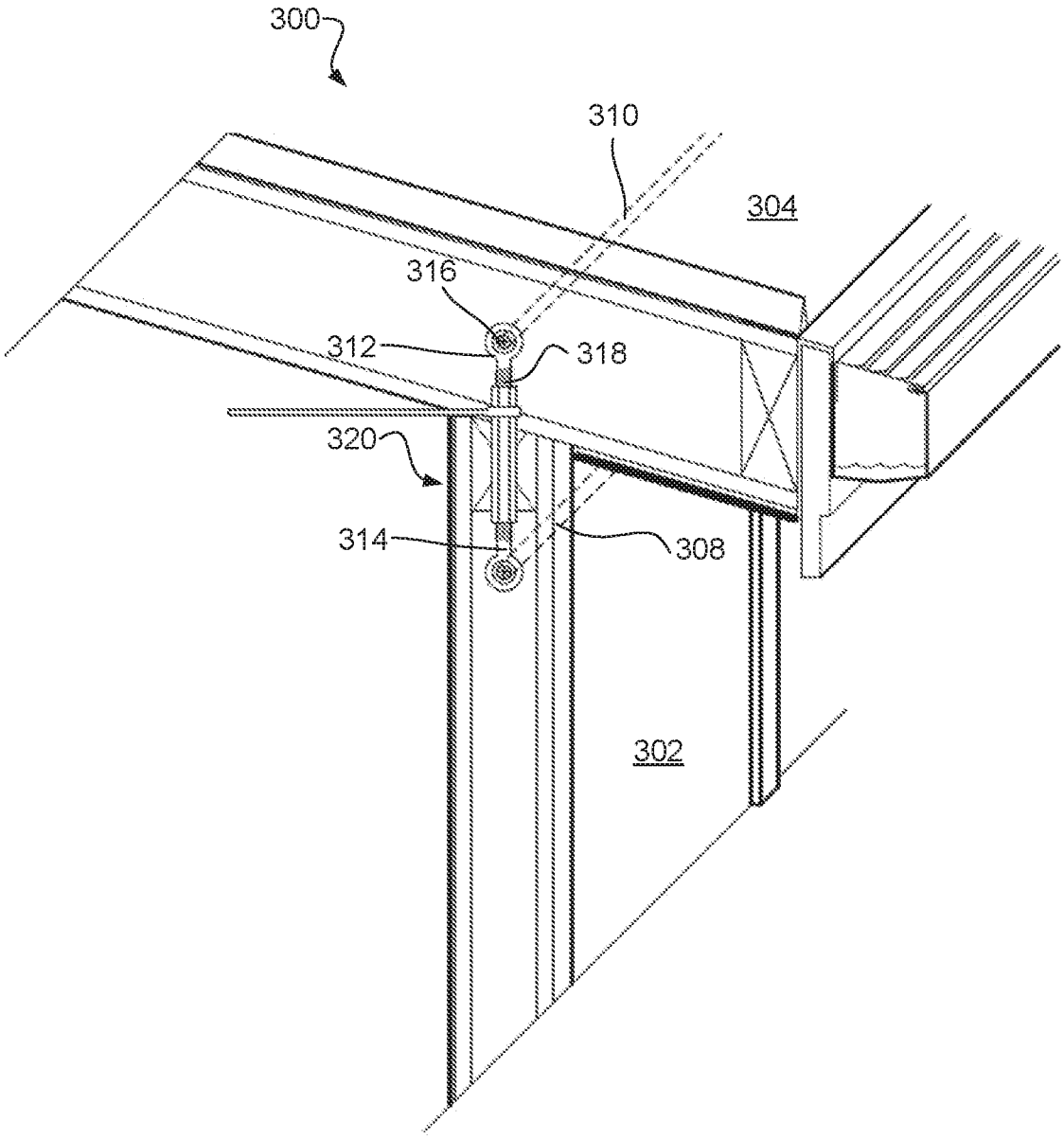
FIG. 13 depicts an example of a connection in accordance with the principles described in the present disclosure.

FIG. 13 depicts an example of a connection 300 between a wall panel 302 and a roof panel 304. In this example, rods 308, 310 are integrated into the thickness of each of the roof panel 304 and the wall panel 302. The rods may be integrated into the wall panel 302 and the roof panel 304 through pre-drilled holes. In some examples, the rods extend the entire length of the roof and/or the entire length of the wall. In alternative examples, some of the rods are shorter the entire length and only span a section of the roof or a span section of the wall.

The uppermost threaded rod 308 of the wall may be attachable to any appropriate position of the corresponding rod 310 of the roof panel. This may be accomplished by attaching a first connector 312 to the roof's rod 310 and a second connector 314 to the wall's rod. The connectors may include an eyelet 316 and a threaded portion 318. But, any appropriate type of connector may be used. The eyelet 316 may be a threaded eyelet that connects to a threaded end 318 of the rods. In some examples, the eyelet can slide freely along the length of the rod, but may be constrained by structures within the wall or the roof panels. The first connector 312 and the second connector 314 may be attached to one another with a turnbuckle 320. The turnbuckle 320 may include threaded inner portions that match the threaded portion of the first connector and the threaded portion of the second connector at the same time. As the turnbuckle is rotated in a first direction, it may tighten and pull in closer the first and second connectors. As the first and second connectors are pulled together, the roof panel and wall panel are also move closer together to form a tight connection. While the turnbuckle connection may be located at various points along the length of the wall and roof, in some examples the turnbuckle connection is just located approximate the ends of the roof and the wall. This may allow a single turnbuckle connection to secure the wall to the roof at a single location or at just the ends of the wall and the roof.

Figure 14:
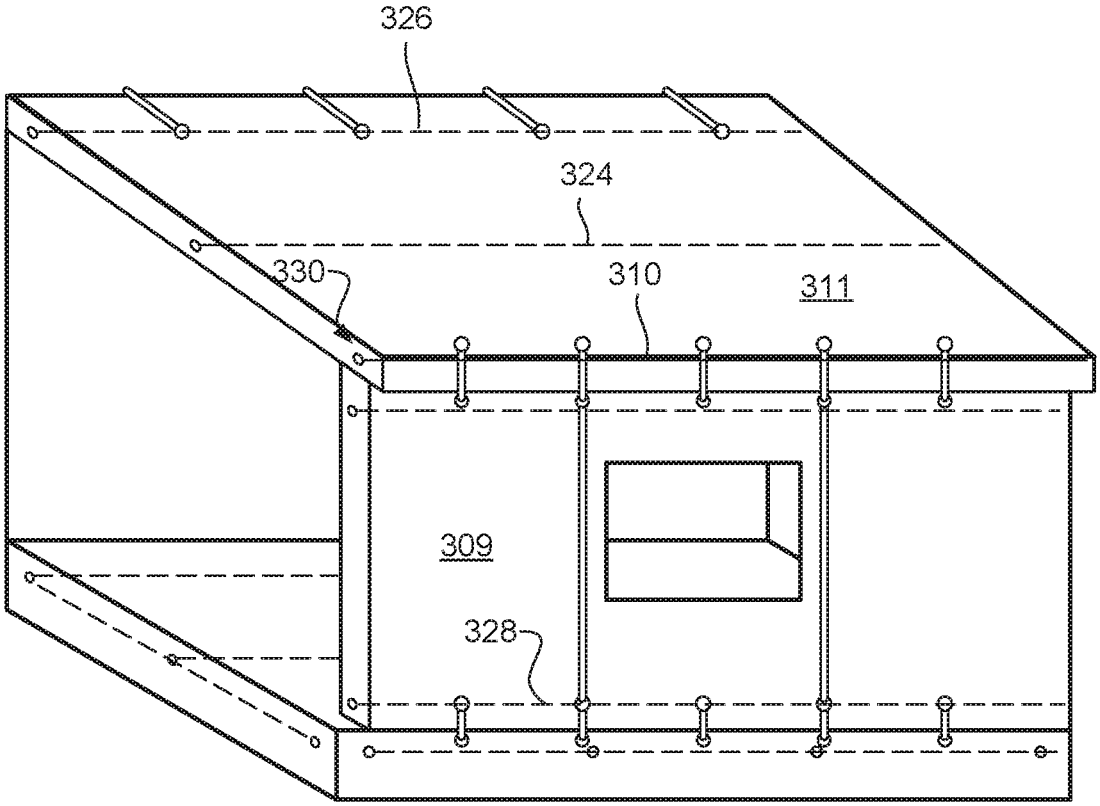
FIG. 14 depicts an example of connections in accordance with the principles described in the present disclosure.

In the example of FIG. 14, multiple turnbuckles are depicted along the length of the rod 310 disposed in the roof and the rod 308 dispose within the wall panels 309. In this example, multiple threaded rods are located within the roof panels 311. Each of the threaded rods 310, 324, 326 are used for connecting roof panels to wall panels and connecting roof panels together. While this example depicts a specific number of turnbuckles attaching the roof to the wall, any appropriate number of turnbuckles may be used to connect the roof to the walls.

In the depicted example, the wall is depicted as having a first threaded rod 308 located proximate top of the wall panel 309 and a second threaded rod 328 located proximate to the bottom of the wall panel 309. The treaded rod located proximate the top of the wall may be used to connect the wall to the roof, and the threaded rod located proximate to the bottom of the wall panel may be used to connect the wall to the floor structure. In some examples, the wall is made of multiple wall segments. In some example, each of the wall segments may include a predrilled hole that receives a single threaded rod that can connect the side panels together. The threaded ends 330 of the rod in the wall sections may receive a threaded nut that can be used to move the different wall panels closer together and synch them into place. Thus, the threaded rod may be used for connecting each of the sidewalls together in a side to side fashion so that the links of each of the wall segments are aligned with each other as well as connecting the wall panels to the roof. In some examples, one side of the rod may include a head, which has a wide diameter than the other portions of the rod. The head may prevent the rod from passing through the pre-drilled hole in wall panel. A threaded section of the rod may be on the opposite end of the rod. The threaded section of the rod may receive a barrel nut, that when tightened on the threaded nut causes the wall panels to pull together.

In the example depicted in FIG. 14, at least one of the threaded rods 326 is located proximate the side of the roof panel proximate the shipping container 100. This rod 326 may be used to connect the roof panel to the container. In some examples, the turnbuckles may hook directly into the side of the container. The rod and turnbuckle arrangement may be used to connect the various types of wall, roof, and floor panels together.

Figure 15:
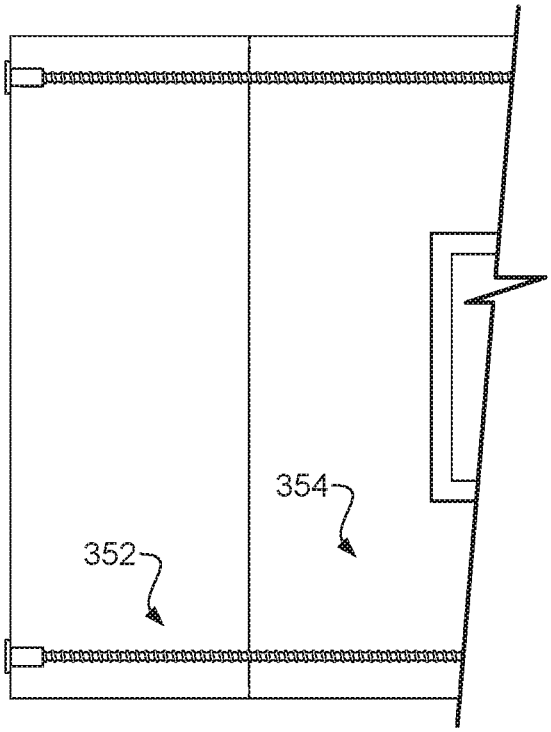
FIG. 15 depicts an example of a connection in accordance with the principles described in the present disclosure.
Figure 16:
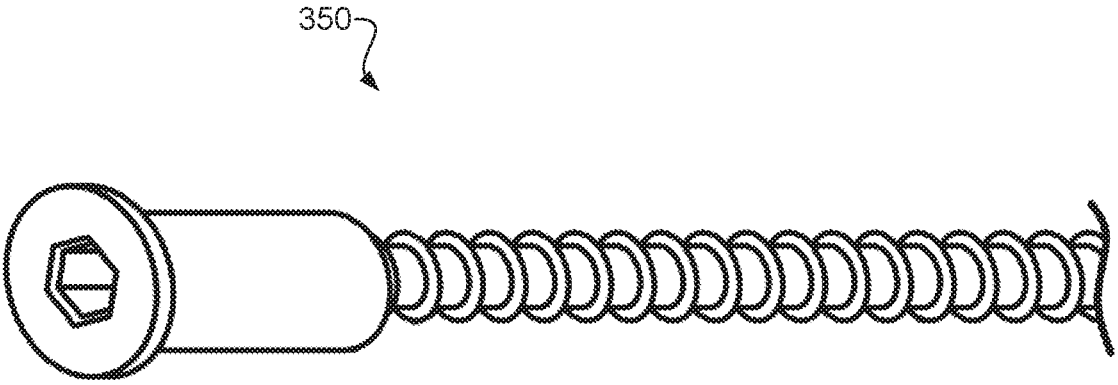
FIG. 16 depicts an example of a connection rod in accordance with the principles described in the present disclosure.
Figure 17:
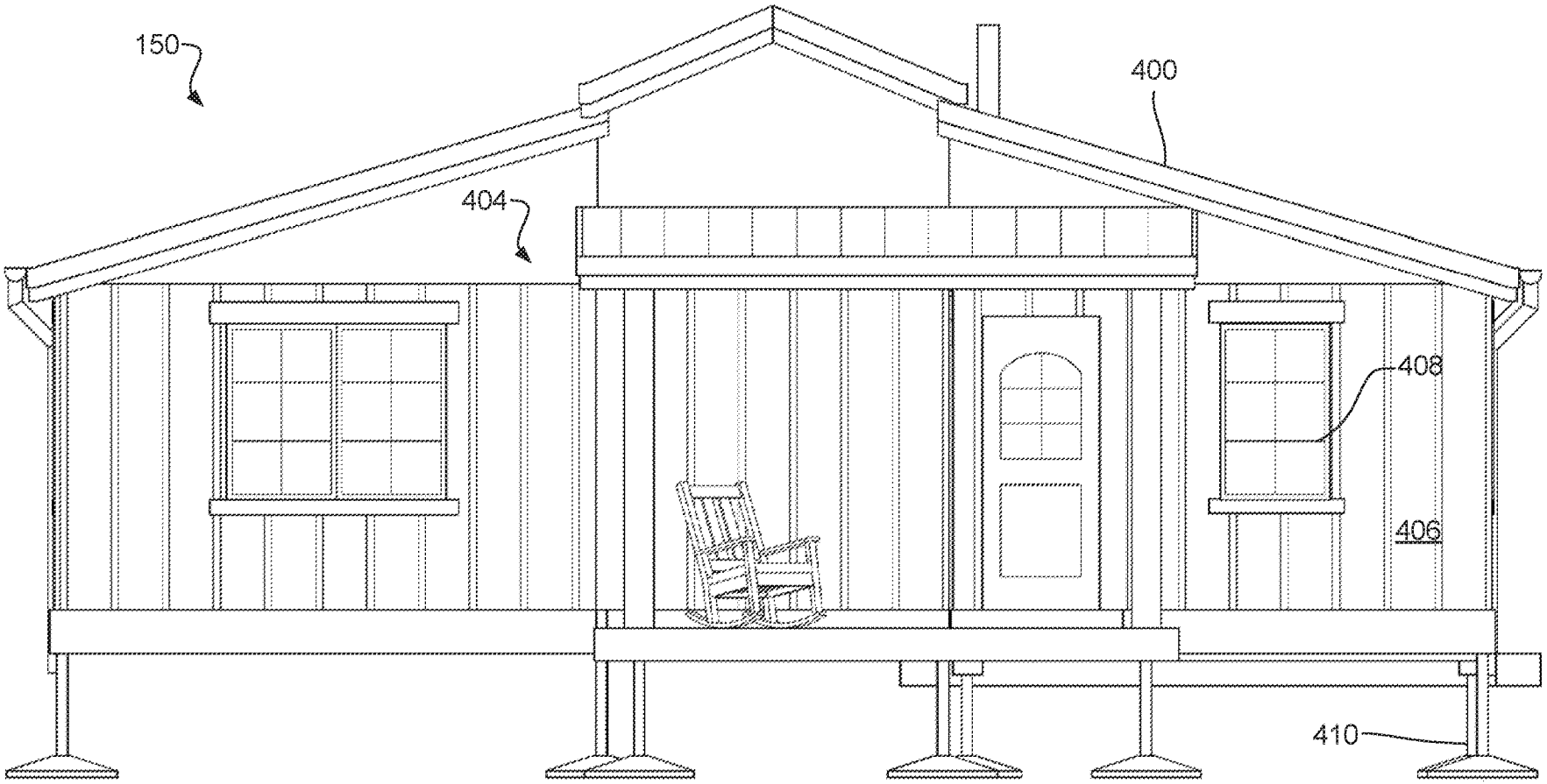
FIG. 17 depicts an example of a constructed building in accordance with the principles described in the present disclosure.
Figure 18:
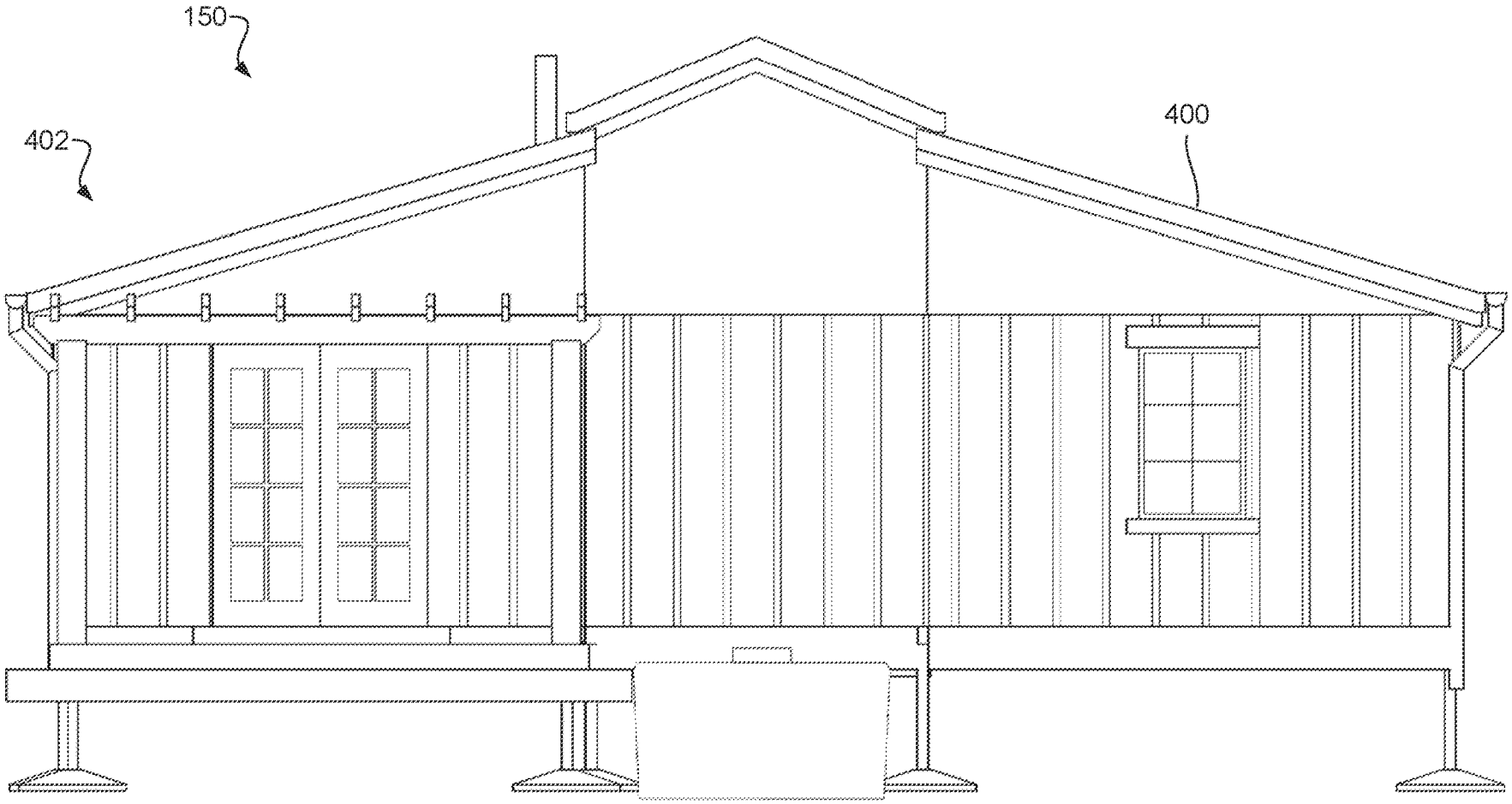
FIG. 18 depicts an example of a constructed building in accordance with the principles described in the present disclosure.
Figure 19:
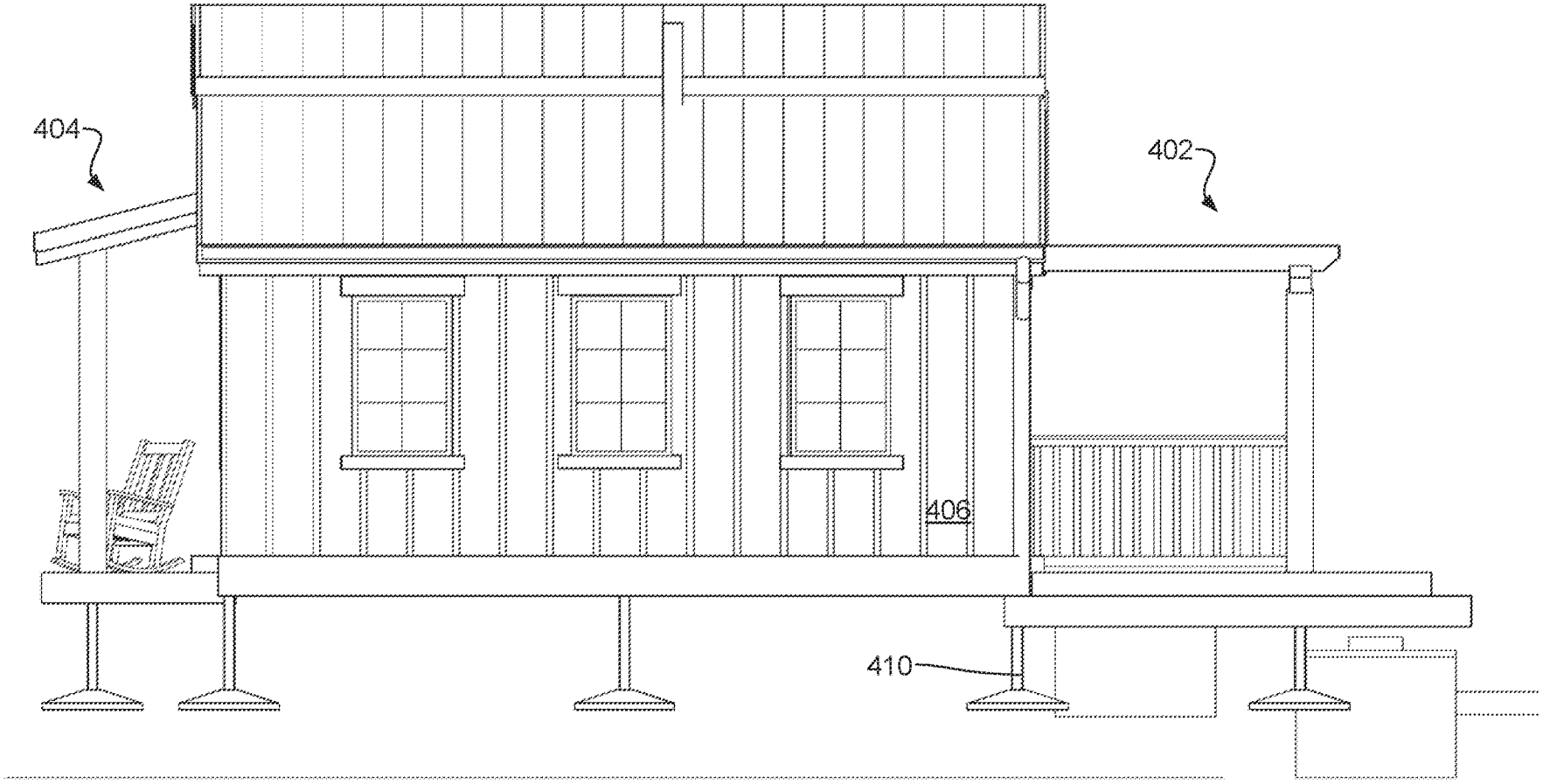
FIG. 19 depicts an example of a constructed building in accordance with the principles described in the present disclosure.

In the examples of FIGS. 15 and 16, a threaded barrel nut 350 is depicted. The threaded barrel nut 350 may be threaded onto the threaded end 352 of the rod 354 to create a head that can anchor the threaded rod onto one side of the panel. In some cases, another type of nut may be attached to the other side of the threaded rod to move the wall panels closer together. In the example of the barrel nut may be tightened with an Allen wrench.

The rod may be made of any appropriate type of metal. In some examples, the metal is a type of steel. In some cases, the rod is a rebar rod with caps that prevent the rod from moving between the wall panels. In some cases, the rod has a thread length along the entire length of the rod. In other examples, the threaded rod only has threaded sections at one or both ends of the rod. In some examples, the eyelets of the turnbuckle connectors can slide along the length of the rod. In other examples, the eyelets are threaded and must be connected along the length of the rod. In alternative examples, the turnbuckles include hooks, rather than eyelets, that can hook to the rod of the panels and the rods of the adjoining panels. In these examples, the turnbuckle connectors don't have to slide along the length of the rod but may be hooked at the desired, longitudinal location for a connection.

Figure 20:
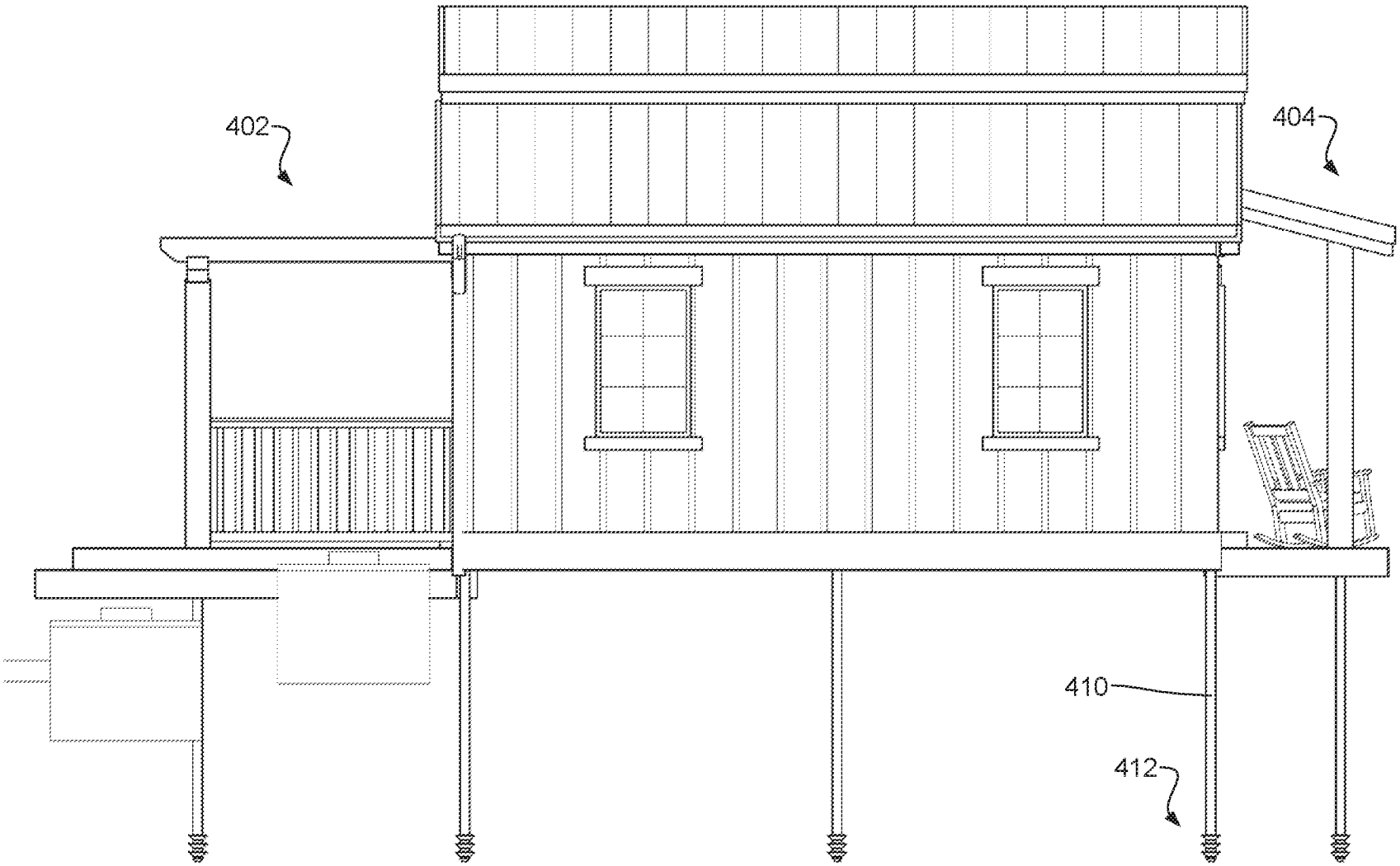
FIG. 20 depicts an example of a constructed building in accordance with the principles described in the present disclosure.

FIGS. 17 through 20 are examples of the constructed building 150 from different sides. Each of these examples includes a roof 400, a back deck 402, a front porch 404, and siding 406. At least some of the sides may include precut windows where the actual windows will be pre-installed in the wall panels prior to shipping. The underside of each of the buildings may be supported with a multiple piles 410. In the example of FIG. 20, the piles 410 are depicted with the drill in component. An alternate to the buried pile foundation is the pile that is drill into the surface. This alternate example may be used in cases where there is a small trailer mounted hydraulic pile drill available in developed areas or where the soil hardness makes hand digging prohibitive. In some examples, the piles are all a consistent lengths. But, in other examples, the piles may be of different heights. In some examples, tools for cutting the piles to a desirable length may be included with the shipping container. In the example of FIG. 20, the attachment features 412 to drill the piles in are depicted. While these examples are described in relation to foundations that are to be buried in dirt and/or rock, the foundation system may be used in an appropriate type of material. In some examples, the foundation system may be built into an existing cement or other type of structure.

Figure 21:
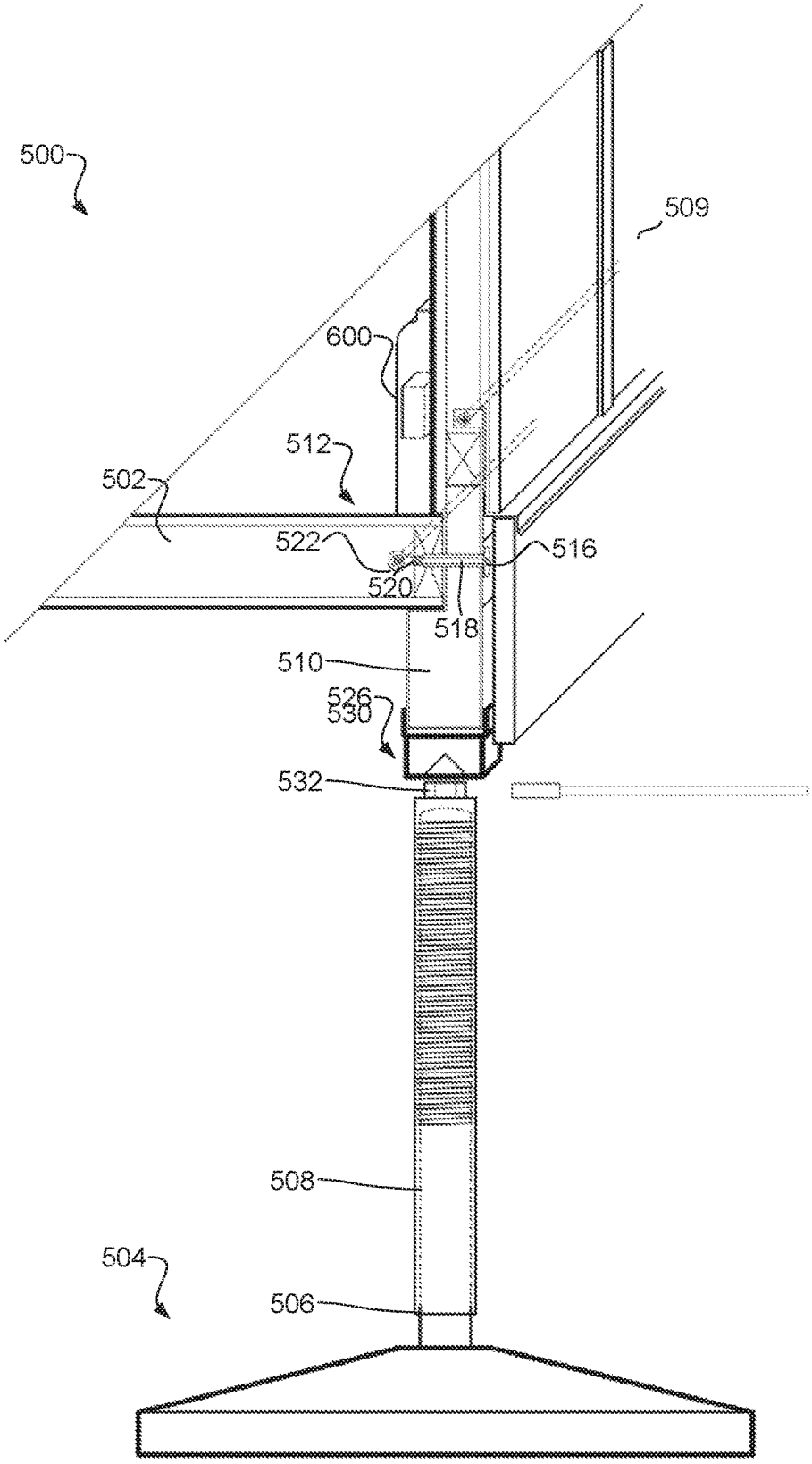
FIG. 21 depicts an example of a foundation system in accordance with the principles described in the present disclosure.

FIG. 21 depicts an example of a foundation system 500 that connects to a floor 502 of the constructed building. In this example, the foundation system 500 includes a footing base 504, an inner threaded rod 506 and an outer sheath 508 that has internal threads.

In this example. the wall panel 509 is connected to the floor structure and the floor panel 502 is connected to the beam 510. The beam 510 is secured to the floor panel 502 with a turnbuckle connection system 512. In this case, the barrel nut includes a head 516, and an elongated outer sheath 518 that receives the threaded end 520 of a turnbuckle connector 522. The turnbuckle connector 522 is connected to a rod integrated into the floor panel with an eyelet around the rod. As the synch barrel nut is tightened with an Allen wrench, the turnbuckle system pulls the floor panel 502 towards the beam 510 for a tight connection. The beam 510 includes a shoulder into which a distal end of the floor panel can rest.

A hanger 526 is connected to the underside of the beam 510. The hanger 526 includes a twist lock interface that allows a twist lock 530 of the foundation system to be inserted into a twist lock interface and twisted to lock into place with the hanger.

The top portion of the foundation system includes a twist lock 530 and at least one wrench flat 532 for engagement with any appropriate type of wrench for rotating the outer sheath 508 of the foundation system. The outer sheath 508 includes internal threads that are threadedly connected to the outer threaded portions of the rod 506. The a wrench rotates the outer sheath 508 at the wrench flats 532 causing the outer sheath to rotate in a first direction, the outer sheath moves upward. As the outer sheath is caused to rotate in opposite direction, the outer sheath moves downward on the rod. By rotating the sheath in one direction or the other, the height of the foundation system can be adjusted. Thus, the level of the constructed building can also be adjusted with wrench flats that are positioned towards the top of the foundation system. In other words, a user does not need to dig down to the bottom of the foundation to fine tune the height of a pile.

The footing base 504 includes a wide base that is tapered towards the rod. A user can dig down to an appropriate level, insert the footing base, insert the pile rod into the footing base, and compact dirt around the pile rod to create a foundation that provides stability to the building.

A baseboard 600 is also depicted in the example FIG. 21. The baseboard 600 may be inserted into the rooms of the constructed building. The baseboard 600 may be positioned against the wall and the floor in each desired room. The baseboard 600 may incorporate electrical wires and may also include electrical outlets. To simplify construction and electrical wiring, the baseboards may be used to house and protect at least a portion of the electrical wiring needs to supply electrical power to the various appliances within the building. The baseboard 600 may also be removable. In some examples of the baseboard may be segmented where the segments may be fitted together.

Figure 22:
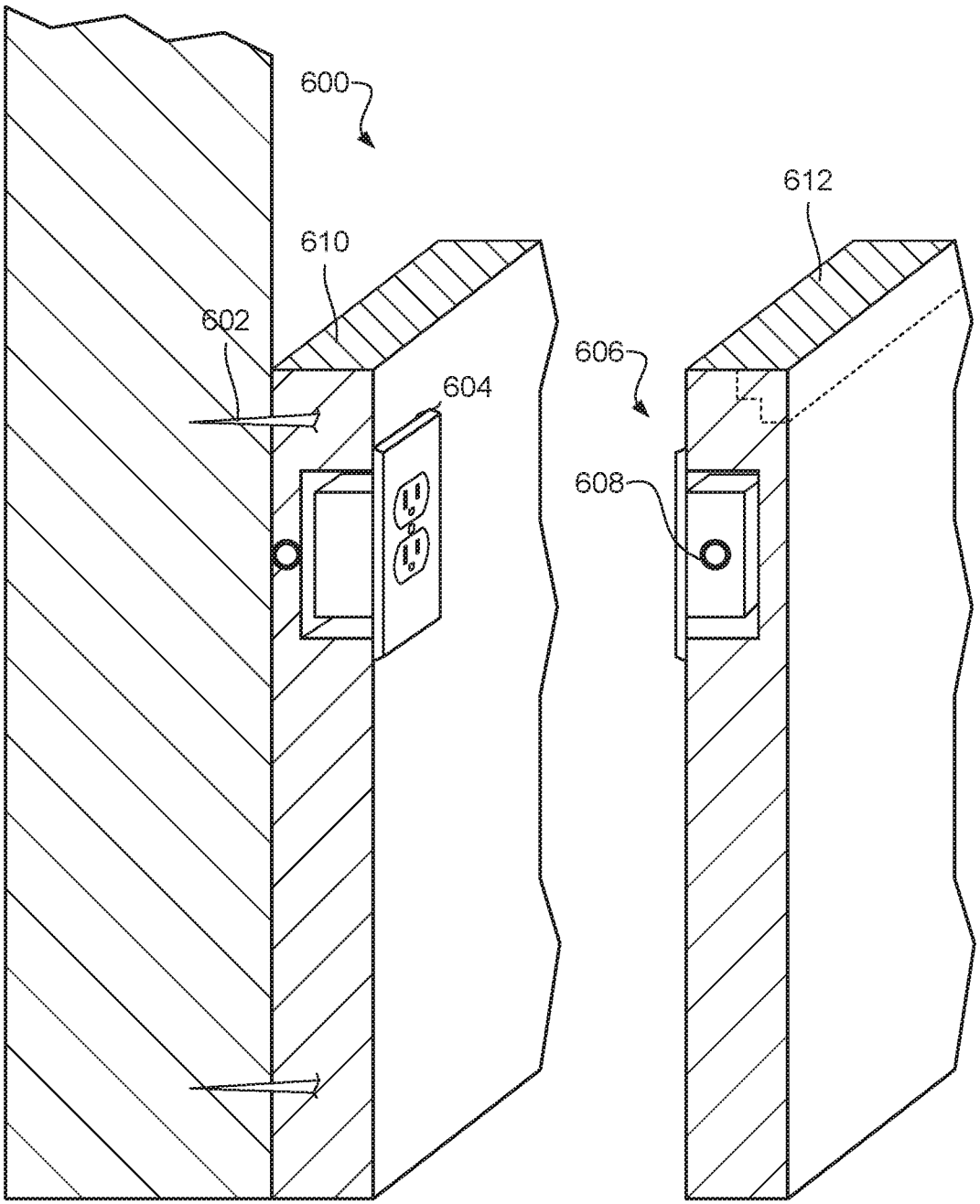
FIG. 22 depicts an example of a foundation system in accordance with the principles described in the present disclosure.

FIG. 22 depicts an example of the power baseboard 600. In this example, the power baseboard 600 is fastened to the wall with tac 602. But, any proper type of fastener may be used. For example, appropriate fasteners may include nails, screws, magnets, other types of fasteners, or combinations thereof. In some examples, no fasteners are used to position the baseboard 600 against the wall.

In this example, an electrical outlet 604 is pre-installed into the baseboard 600. The electrical outlet 604 may be connected to wires already installed in the baseboard 600. The wires may be connected to a power source integrated into at least one of the walls of the building. In such an example, only one power source may be within the room to communicate with the baseboard 600. The baseboard 600 may have any appropriate number of electrical outlets for powering electrical appliances or may provide an appropriate number of outlets to satisfy applicable local code requirements.

In some cases, the baseboard 600 may be segmented. In some examples, the segments are constructed to attach together. A segmented baseboard is pre-strung with a continuous wire so that the baseboard pieces are held together in a collapsed position. A hinge connection created by the common wire 606 may allow the baseboard 600 to be folded together and stored in the shipping container during transport. An electrical connection 608 depicts the outlets completed prior to shipping in a first segment 610 and the wires of a second segment may form a continuous wire when the baseboard is fully installed within a room. In some cases, the continuous finished wiring will be encompassed by a channel or conduit channel within the base so that the wire will be protected when the base is unfolded and installed in the room.

Figure 23:
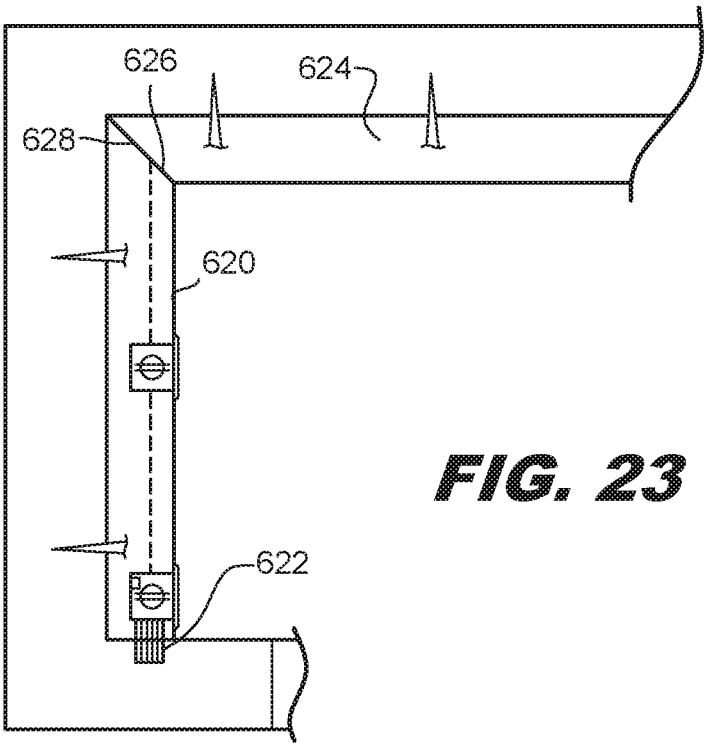
FIG. 23 depicts an example of a foundation system in accordance with the principles described in the present disclosure.

FIG. 23 depicts an example of a baseboard segment 620 in communication with an A/C Power source 622. FIG. 23 also depicts two baseboard power segments 620, 624 connected together in a corner of a room. In this example, each end of the baseboard segments are cut at a 45 degree angle. A first 45 degree face 626 of the first baseboard segment 620 is in contact with a second 45 degree face 628 of a second baseboard segment 624. Collectively, with the two faces connected to each other the first segment and the second segment of the baseboard form a 90 degree angle. This 90 degree turn in the baseboard can be inserted into a corner of the room. Also, as the two 45 degree faces are joined together, the wires of the first baseboard are automatically aligned with the wires of the second baseboard. In some examples, a square joint or coped joint may be used for the base board joints. The baseboard of the first segment in the segment of the second baseboard may be fastened to the walls of the room.

Figure 24:
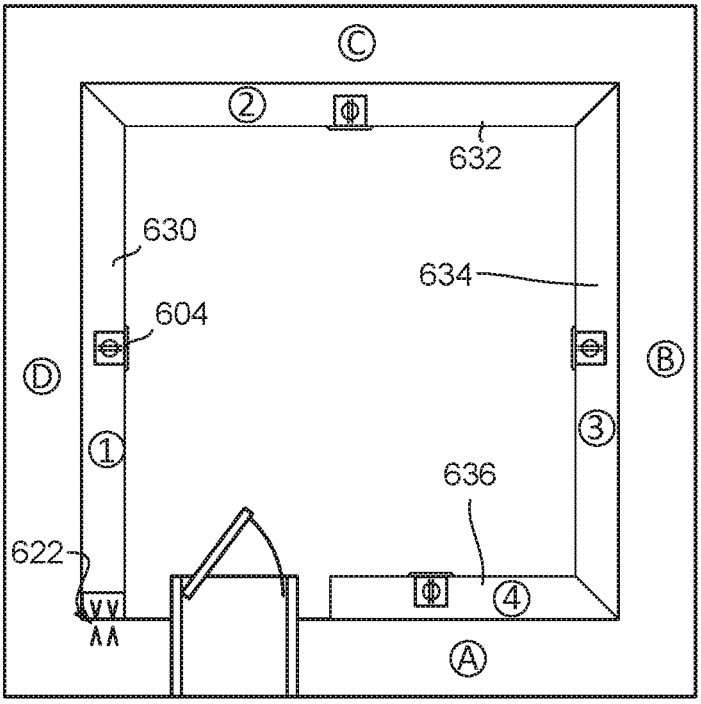
FIG. 24 depicts an example of a foundation system in accordance with the principles described in the present disclosure.
Figure 25:
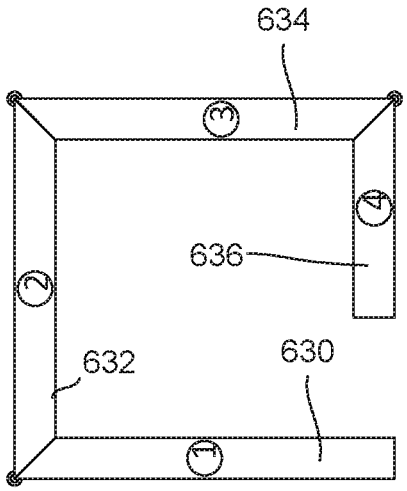
FIG. 25 depicts an example of a foundation system in accordance with the principles described in the present disclosure.
Figure 26:
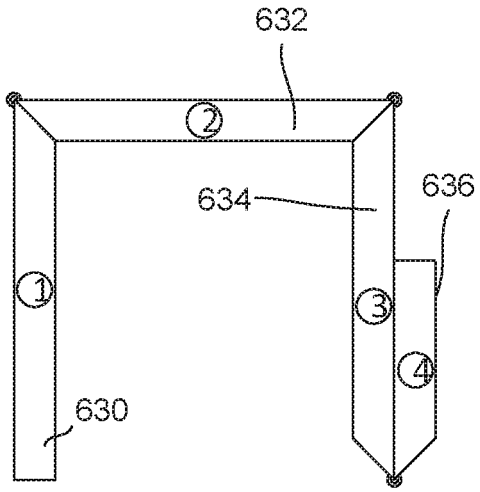
FIG. 26 depicts an example of a foundation system in accordance with the principles described in the present disclosure.
Figure 27:
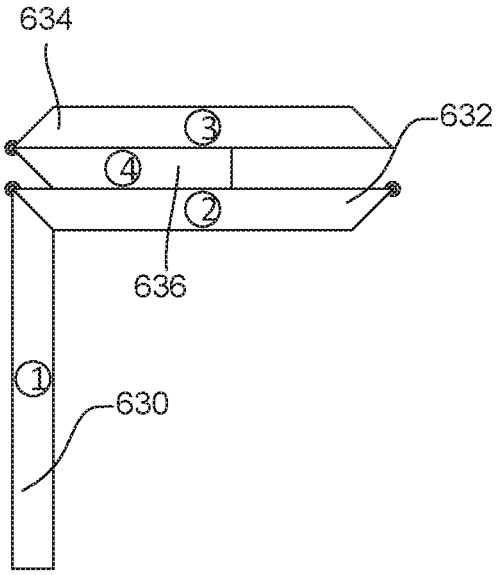
FIG. 27 depicts an example of a foundation system in accordance with the principles described in the present disclosure.
Figure 28:
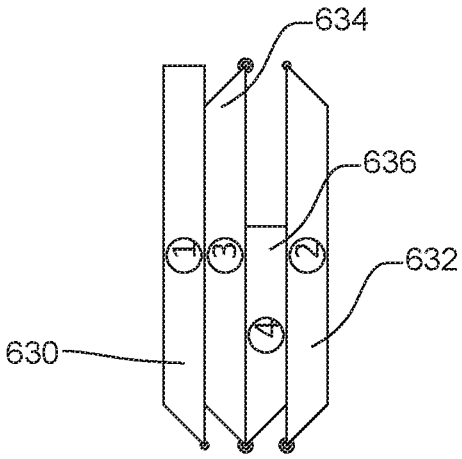
FIG. 28 depicts an example of a foundation system in accordance with the principles described in the present disclosure.

FIG. 24 depicts an example of a room with a segmented baseboard 600 fitted to the foot of the walls of that room. Each segment 630, 632, 634, 636 corresponds to the length of each side of the room. In some of the corners, the 45 degree faces of different segments come together to join the baseboard segments together, which allows the continuous wire to be fully encapsulated in the wire channel. In this example, each of the baseboard segments include electrical outlet 604. Each of the segments may be sized to have a length matching the length of its corresponding wall. Further, in a situations where a wall has a door, the baseboard may be broken into two different segments, one for each wall portion on either side of the door.

While this example depicts that each segment corresponds to the entire length of the wall, the baseboards may have any appropriate length. In some examples, the baseboard segments may be smaller than the length of the wall. In such an example, the baseboards may snap together or otherwise join together to form a straight connection with each of the two segments being aligned with each other forming a longer baseboard section.

The power source 622 may be any appropriate type of power source. For example, the power source may employ alternating electrical current. In other examples, the electrical source may be a direct current source. In some cases, the power source is provided from solar energy harvested from the building. In one example, a solar panel is employed by the building to provide the power. In another example, the building is connected to an electrical grid and receives alternating current through the grid. In another example, the power source is connected to a windmill or another alternative type of energy source. In some examples, the power source is connected to a battery that provides a direct electrical current to the power baseboard.

FIGS. 25-28 depicts different stages of folding the power baseboard 600. In this example, the power baseboard 600 includes four segments 630, 632, 634, 636. Each of the segments bend with the wire remaining in place. In some examples, at least one of baseboard segments may be rotated appropriately 270 degree so that the back sides of each of the baseboard segments are back to back. In the depicted example, the fourth baseboard segment 636 is folded backwards so that the back of the fourth segment 636 is up against the back of the third baseboard segment 634. In this example, the third segment 634 is rotated nearly 270 degrees. At this point, the third segment 634 is disconnected from the second segment 632 so that the fourth segment 636 and the second segment 632 are back to back. Likewise, the first segment 630 and the second segment 632 are also disconnected so that the first segment 630 may be up against the third segment 634. In this example, the continuous wiring stays in place with the loose unconnected end retracting slightly to allow for the base segments to fold together.

In some examples, when the baseboards are folded, electrical wires are not disconnected. In some cases, a continuous single wire connects one or more of the segments. In one example, when the segments are folded, a wire retracts within a routed channel defined in the baseboard. In such examples, the connection and the wire may extend to allow slack for the connection after the baseboard is unfolded.

In some examples, the building includes just one room that is prewired with the baseboard. In yet another example, each room includes a power baseboard fitted for that room. Any other examples, the baseboards only cover a selected portion of the room. For example, a baseboard may only cover one side of the room. In such example, the baseboard may not be segmented, but may be just a single solid piece.

General Description of the Technology

In general, the principles disclosed herein may provide users with a building structure that can be shipped anywhere in the world via rail, seaborne shipping, truck, airplane, helicopter, another type of transportation, or combinations thereof. The use of the intermodal container may be economical to purchase, transport, deliver, and erect. The building can be used for variety of building types such as for housing, clinics, and educational facilities. The building can be off-grid with solar power, LED lighting, gutter water collection, and mini-septic. In some examples, all of the components needed to construct the building can be packaged in the intermodal container. Thus, all structural components, panels, fasteners, tools, ladders, shovels, and so forth can be conveniently shipped to remote areas and can be constructed by unskilled labor without having to rely on personal tools. The building can be constructed with established and tested building materials that may endure many years, such as the intermodal container and Structural Insulated Panels (SIPS).

The principles may also provide the user with building components that are easy to install. The building can be built relatively quickly. For example, a permanent building may be installed by two unskilled works in less than a week. The building may also be pre-wired for exterior utility connections in areas with an established infrastructure. The building may also be installed with low flow plumbing fixtures and efficient appliances. In those cases where the building is to be transported by helicopter, the intermodal container can have the structural integrity, weight, and connecting points that make transport by helicopter convenient.

Further, constructing a single level building does not have to require on-site mechanized equipment. In some cases, the buildings can be rapidly constructed with completely unskilled labor. In one example, a 640 square foot unit may be completed with two adults working roughly 40 hours. The instructions for constructing the building may be included in the intermodal container and may be understood by a wide variety of people across many languages and cultures by using pictures and numbered color-coding. The connections holding the structural components of the home together may be easily disassembled, allowing the building to be repackaged, moved, and re-built multiple times. In some cases, each piece packaged in the container can be sequentially extracted and installed into the building as it is pulled from the container thereby eliminating a need for a staging area. Further, in many examples, no on-site material resources are needed for construction, everything necessary to build the building comes in the container it is shipped in (including tools, like ladders and shovels).

The principles described herein may also provide the user with an easy to install foundation. To build the foundation, the ground may be excavated by hand and the foundation can also be installed by hand. A pile foundation can be used with integrated hold-down fasteners to mitigate up-forces that occur in many natural disasters. The pile foundation may be adjustable to accommodate uneven or shifting terrain.

The invention may also provide the user with panels that come with integrated fasteners that may protect the outer shell against high winds and earthquakes. In some cases, the walls, roof, and flooring may incorporate SIPS Panel Technology that uses a material having a high thermal resistance to reduce the amount of heating and cooling required in the building. These panels may be fastened to the outside of the intermodal container. Thus, the volume within the intermodal container may define a room that becomes an inner room of the building. Further, the exterior walls of the intermodal container may become internal walls of the building. The intermodal container may provide a disaster safety pod that is constructed to withstand any number of natural disasters such as earthquake, hurricane, tornado, and fire. Further, the intermodal container can be locked and may be resistant to vandalism thereby providing a safe storage area to secure furnishings, pharmaceuticals, and other valuables as well as protect against intrusion from unwanted visitors.

The invention may also provide the user with the structural strength of container core combined with expandable wall system flexibility. The expandable wall system allows for numerous size variations and applications for multiple units. The building can also be aesthetically diverse and attractive with multiple exterior looks, styles, and colors.

The invention may also provide the user with exterior hook-ups for utilities, solar power management, inverted 120 volt power, and low-voltage LED lighting. In some cases, the pre-wired baseboard is provided that meets International Building Code (IBC) requirements in the United States, Europe, and other developed countries. Further, the invention may include water management through gutter water collection, multiple cistern water storage, and a septic system. The building may also include wood-burning heating/cooking devices and climate control systems.

The components for the building may be packaged into an intermodal container and shipped to the desired location for installing the building. The intermodal container may be repurposed at the construction site and become a structural component of the building. Paneling for additional walls, roofing, and flooring may be packaged within the intermodal container during transportation. But, on-site, these panels may be fastened to the intermodal container and to each other. The finished building may include multiple rooms. One of the rooms may be defined, at least in part, by the intermodal container. The exterior walls of the intermodal container may become the interior walls of the building.

Packaged Intermodal Container

In some cases, the intermodal container includes a first longitudinal side and a second longitudinal side that is aligned with the first longitudinal side. The first and second longitudinal sides are connected by a front side and a rear side. The front side, rear side, and the first and second longitudinal sides form a perimeter of the intermodal container. The intermodal container also includes a container roof connected to the top of the container's sides and a container floor that is connected to a bottom of the container's sides. With the building constructed, the first and second longitudinal sides may become internal walls of the building.

The intermodal container may include openings cut out of the container before shipping to form passages between future rooms of the building. With the construction of the building complete, these cutouts become the internal doorways between rooms of the building. Before shipping, storm doors that meet the ISO criteria may be incorporated into the intermodal container at the cut outs. These doors may be closed during transportation to protect the contents in the intermodal container. With the construction of the building completed, the storm doors can serve as storm and vandalism resistant doors that can be locked. The construction of the intermodal container can withstand heavy loads that often occur when heavy payloads and lifted, moved, stacked, or otherwise directed at high speeds. The robust construction serves well in the completed building because the room formed by the intermodal container can withstand natural disasters, violent individuals, thieves, and other dangerous circumstances. Thus, the intermodal container can form a safety pod that provides a higher level of security and/or safety.

Besides the paneling, beams, and other structural components used to finish the building, other non-structural building components may also be packaged within the intermodal container during transport and become available on site during construction. For example, the components for the water system, components for the foundation system, components for electrical system, components for the septic system, components for a climate control system, components for an entertainment system, components for a cooking system, kitchen components, bathroom components, bedding, furniture, gardening components, exercise components, medical diagnostic equipment, garage components, other type of components may also be packaged in the container during transport. Additionally, tools for constructing the building and installing the building's various components may also be packaged in the intermodal container during transport and become available on site during construction.

In some embodiments, all the necessary components are placed inside the intermodal container at the production facility. The containers are then transported by truck, rail, ship, or helicopter to their intended location.

In addition to the transport efficiency in shipping, rail, and trucking, the intermodal containers are also built for air transport, thereby increasing the expedient transit and possible remote locations that the pre-packaged building can be transported to. For example, the intermodal container can be constructed for helicopter transport. The pre-packaged building may be made of materials that make the collective weight of the contents in the intermodal container to be under the threshold of common rotary-wing transport vehicles. The intermodal container can be connected to the helicopter's harness through twist lock connections points, and the intermodal container itself has the structural integrity to be hoisted in the air without bending. Further, in examples where the intermodal container is 20 feet long, two of the intermodal containers can fit in the cargo hold of a C-130 transport plane and then can be easily transported by Chinook Helicopter to any remote location. A 20 foot medical unit could be delivered to a triage site just hours after a natural disaster.

On location, unskilled labor can systematically extract the components while guided by an installation manual that includes pictures and numbered directives to eliminate language barriers. The interior of the container may be finished with primary components and interior walls prior to packaging with the foundation, floor, wall, roof and other various components. As an example, the 20 foot intermodal container can be modified to contain a finished full bath and kitchen before shipping. The remainder of the space in the intermodal container may be used to strategically package all the remaining components required to construct the building.

After the interior of the container is complete, floor, wall, roof, and various structural components are labeled and strategically packed inside the container for future removal. In some examples, each component may be systematically extracted at the construction site and placed by hand to form the foundation, infrastructure and outer shell that increases the finished building. In some cases, the increased square footage of the building from the intermodal container may be roughly 400%. The shipping container can remain as the core structure of the building and provide the safety due to the high structural integrity of the intermodal container. Depending on the finished floor plan, exterior openings are installed in the container's sides for future use as interior passageways between rooms. Specialized overhead storm doors on the exterior openings can be installed in these doorways while maintaining ISO intermodal certifications during international transport and later allow for access to the container's packaged components during the construction phase. In an example with a 20 foot container, the container initially contains approximately 160 square feet. After the building is constructed, the building expands this initial volume to 640 square feet.

When the structure is complete, a new exterior shell encapsulates the intermodal container with numerous configurations and provides significant durability with quality building products and specialized connection details. The enhanced exterior structure is specially constructed to withstand a barrage of potential forces from natural disasters such as earthquakes and high velocity winds. An additional layer of security and protection may be available when a threatening event occurs by retreating to the central container core. Even without adult supervision present, the overhead storm doors can be closed and locked to form the interior safety pod, by anyone capable of grabbing an emergency strap roughly six feet above the floor. The building can be used for any appropriate application, such as for single family housing, multifamily housing, dorm facilities, medical clinics, educational and civil meeting facilities, military applications, other types of applications, or combinations thereof.

General Installation

The building may be pre-package to include the components, tools, and instructions needed by unskilled labor to construct the building. The instructions may include connection details, piece labeling and color-coded installation details that may allow completely unskilled labor to install components in a relatively short amount of time. In one example, where the intermodal container is 20 feet long and the complete building has 640 square feet, it is believe that two unskilled adults can construct the building in under 40 hours. In this example, it is believed that the two adults can install the foundation in 14 hours. In this example, the pile foundation may involve digging multiple holes to install a pile with a footing. In one example, the holes are a minimum of 30 inches deep for uplift protection. In some situations, additional depth may be required to reach below frost level and prevent heaving in climates with lower temperatures.

Continuing with this example, it is believe that the two adults may complete the leveling and floor construction in about 10 hours. This phase of construction may include installing the floor structure to the intermodal container's floor. The floor structure may include precut panels manufactured to install with twist-lock connections into the pile foundation. A system of rim and beam combinations may be used depending on model, load, span, and performance needs of the building. The rim and beam structures may provide the base for floor, wall, and roof bearing. In one example, the floor system uses a rim of treated Parallam material for structural span strength, pest control, and rot resistance. Floor structures can be infinitely expanded and stacked up to six floors high if desired. SIPS panels may be used for the floor system with varying thicknesses and application. Any appropriate type of material may be used for the flooring's rim and beam materials. For example, a non-exhaustive list of materials that may be used in the building's flooring system includes microlam, other wood manufactured products, wood timbers, composite beams, metal beams, other types of materials, or combinations thereof.

Also, in this example, the walls may take the two adults another six hours to complete. The exterior and interior walls may also use SIPS for insulation, strength, durability, and a low environmental impact. The walls may be prepackaged with windows, doors, and finish material installed. The walls may be interconnected to the floor and roof systems. Any appropriate type of material may be used for the wall frames. For example, a non-exhaustive list of materials that may be used in the wall frames includes metal frame wall, composite walls, wood frame walls, other types of materials, or combinations thereof.

Again, continuing with this example, the two adults may take an additional 10 hours to construct the roof. The roof system may use a Parallam timber beam system that interconnects into wall pockets and SIPS roof panels with raised seamed metal roofing and prefinished interiors. Roof panels can be interconnected and rendered water-tight by using a proprietary snap on cap between panels, valley flashing, and lock-in drip-fascia-gutter combo. Any appropriate type of material may be used for the roof panels. For example, a non-exhaustive list of materials that may be used in the wall frames includes metal frame wall, composite walls, wood frame walls, other types of materials, or combinations thereof.

Multiple single-level units can be interconnected, expanded indefinitely and built without mechanization or skilled labor. Multiple level units may only require the initial containers to be stacked and secured using the integrated twist-lock connections. Complete installation and construction can then commence without mechanization and with unskilled manpower and provided ladders.

Professional skilled labor may not be commonly available in developing areas. To accommodate unskilled workers, an installation manual contains pictures and numbered color labeling. A spiral bound, waterproof, durable manual renders an inexperienced labor force able to construct the building. In some examples, to accommodate an unskilled labor force, no screws, nails or power tools may be needed to produce the building.

In some examples, building materials can be extracted from the intermodal container in the order the materials are needed for construction. This saves space as an area for staging materials may be not be needed. Thus, the components may remain in the container until ready to be pulled and placed in the structure. This unique pull-and-place feature prevents the inefficiency of multiple moves and helps reduce theft, injury, and damage of materials. This sequential extraction also allows for multiple level construction by initially providing materials for a platform to be built to allow safe access on the working level for all components. The platform may then be incorporated into the completed structures floor plan.

Further, in some examples, construction of the building does not need pre-construction preparation that involve machinery and materials. The local unskilled labor may perform all ground preparations with ladders, shovels, and hand tools contained in the intermodal container.

Foundation

In some examples, the building's pile foundation system can be installed by hand. In some cases, the pile foundation can be excavated after the container has been dropped. Shovels and ladders for excavating the ground are included in the delivered unit.

In one example, the installation of the foundation system may be installed by digging multiple holes. In some examples with a 20 foot long intermodal container, 12 holes are dug, but any appropriate number of hole may be dug in accordance with the principles described in the present disclosure. Further, the holes may be dug to any appropriate width and depth to meet the final design criteria. In some examples, the holes are dug to 30 inches wide and roughly three feet deep in the native soil surrounding the intermodal container. Additional foundation piles can be installed to support supplementary structures, such as a porch or deck.

In some examples, the pile is an adjustable pile that includes a footing and a pipe connected to the footing. The pipe may include a stationary portion and a height adjustable portion movably connected to the stationary portion. In some cases, the stationary portion includes an internal threaded rod, and the height adjustable portion includes an outer sheath. The internal threaded rod may be disposed within the outer sheath where the internal threaded rod and the thread form of the outer sheath are intermeshed.

In some cases, the stationary portion is rotationally fixed with respect to the footing, and the height adjustable portion is rotatably movable with respect to the footing. The adjustable pile may lengthen when the outer sheath is rotated in a first direction with respect to the stationary portion, and the adjustable pile shortens when the height adjustable portion is rotated in a second direction with respect to the stationary portion where the second direction is opposite the first direction. In some cases, the height adjustable portion includes an outer surface, and a wrench flat formed in the outer surface. A user may use any appropriate tool to rotate the height adjustable portion. In some cases, the user applies torque to the height adjustable portion through the wrench flat. In some situations the user can use a power tool to rotate the height adjustable portion. But, in other examples, the user may cause the height adjustable portion to rotate through the use of a manual tool. The height adjustable portion may include an attachment to a building structure. In some examples, the building structure is a portion of the intermodal container, a floor beam, a floor structure, a wall structure, a roof structure, another portion of the building, or combinations thereof.

The footing may be a fabricated disk. The footing may be made of any appropriate material. In some cases, the footing is made of aluminum or composite, and is placed in the bottom of the hole. A foundation pipe may be attached to the footing. In some situations, a stationary portion of the pipe is integrally formed with the footing. In other examples, the pipe is removably attached to the footing. In at least one example, the pipe can be threaded into the footing before or after the footing has been placed in the dug-out hole.

The pipes may be connected to the building structure in any appropriate location and with any appropriate mechanism. In one example, the foundation pipe has a threaded internal rod integrated with a twist-lock that attaches to the existing corner twist lock tie-downs on the intermodal container. A pile may correspond to each of the corners of the intermodal container and each of the corners of the building. Further, additional tie down locations can be incorporated into the intermodal container and other locations in the floor structure and/or wall structure. In one instance, an additional connection point between the pipe and the intermodal container is formed at the midpoint of the long side of each container. The connection points may be pre-fabricated as desired, but in some examples, the connections are spaced at 10 feet increments. In one example, two sets of three holes are correspondingly dug 12 feet out and parallel to each long side of the container to accommodate the foundation piles for the expanded structure connected to the intermodal container. The expanded portion of the structure may use additional twist-lock connecters for each intersection and bearing area of the outer structure.

After the foundation holes are excavated, the footing base and connected piles may be installed. The holes containing the installed pile assemblies can be backfilled by hand with the native material. The piles may then be twisted with a provided wrench and the container is lifted off of grade to accommodate the next phase of exterior structure installation.

In developed areas that can access fuel, an optional screw-in pile can be used that contains the same twist-lock connections and uses a small hydraulic pump system in a pickup bed or trailer. This option allows for expedited on-site foundation installation. This mechanized screw-in option modifies a time-tested pile foundation building system and incorporates our twist-lock coordinated connection system. Depending on soil conditions, the lower bit section of foundation pile may be lengthened with additional pipe sections as it drills down, utilizing a threaded connection. A depth of 4 feet to 10 feet, depending on soil conditions, may provide enough rotary resistance to establish the bearing, shear and up-force for the structure.

The foundation piles may have the ability to be adjusted vertically. In some cases, the pile contains an adjustable section that can also be screwed on top of the drill in option. In this example, the pile includes a footing base of structural metal or composite that is manufactured in a shallow cone to allow for nesting in shipping. In some cases, the base of the footing may be increased from the standard widths for areas that produce dramatically high loads, such as high altitude areas that have high snow loads. Additional pile foundation bearing capacity may also be required for multiple-level units.

The pile may also include a metal base-pipe that interlocks on the bottom into the round footing base or threads onto the pipe of the drill-in option. The footing base and pipe sections can be shipped separately and connected on-site. The base-pipe may have a male threaded portion.

An upper portion of the pile may contain a female threaded portion that sleeves the lower pipe and protects the threads as the sections are screwed apart. The upper section may be capped on top and connects to the twist-lock that fastens to the container and designated structural areas of the extended portion of the structure. The upper portion may have a hex nut welded to facilitate the twist lock connection and allow for a wrench to turn the upper pipe and adjust the pile height. The top section's skirt protects the lower threads from debris and helps to prevent thread corrosion that may allow for future adjustment in the event of settling or shifting. Stop-cogs may prevent the two sections from completely twisting apart and retain enough engaged threads for up-lift protection.

In some examples, the foundation pile can be installed by digging a hole, by hand or with equipment, adequate enough to accommodate frost line considerations and large enough to accommodate the pile base required for the structure requirements. The foundation base may be made of composite or metal. The base may be backfilled to secure pile foots against uplift. In the event there is access to a small trailer with available pneumatics, the lower pile foundation may not use the platform base and may instead use one of several drillable systems currently available on the market. The foundation pile may then utilize all the proprietary height adjustable components and connection details that will thread into the top of the pile. The pile system top may include a threaded male rod encapsulated by an outer female pipe the allows for foundation adjustment and added long term protection of the threads under grade. The foundation pile may be secured to the container core and outer extended structure will a series of bolts and/or twist locks.

Panels

The building may incorporate panels that connect to the frame of the floor, walls, and roof. These panels may be insulated or non-insulated. In some cases, the panels include paint, protective coatings, aesthetic features, other features, or combinations thereof. In those examples where the panels include insulation, the insulated panels may increase the thermal resistance of the wall, floor, and/or roof and better insulate the interior of the building the environment's ambient temperatures.

Any appropriate type of insulated panel may be used. One example of an insulated panel that may be used includes a Structural Insulated Panel (SIP). A SIP may include a composite building material that has an insulating layer sandwiched between two layers of structural board. The insulating layer may be rigid and also provides additional structural integrity. The board can be sheet metal, plywood, cement, magnesium oxide board, oriented strand board, expanded polystyrene foam, extruded polystyrene foam, polyurethane foam, composite honeycomb, another type of foam, another type of material, or combinations thereof. In some examples, the SIPs have a thermal resistance value of about 4 $K \cdot m^2/W$ per 25 mm thickness.

SIPS may be used for the floor, wall, and roof. These panels may be light, energy efficient, green, and have great structural integrity. Harmful emissions may be engineered out of the foam, glue, and shear panels. The perimeter of each wall panel may be wrapped with a 2× material depending on the thickness of the panel and additional 2× material may be placed for bearing pints or headers as desired. The panels may be stacked vertically and horizontally within the container in various lengths and widths depending on look and application. The exterior elements, including doors, windows, siding, and roofing may be attached to the various panels. An infrastructure of manufactured lumber product may be used as a bearing base and the panels are placed with proprietary connections to form the floor, wall, and roof of the outer shell.

In some examples, the building may include integrated fasteners that may protect the building's outer shell against high wind and earthquake. The building may include pre-cut and manufactured elements that interconnect without standard nailing and fasteners. In one example, the pile foundation uses the twist-lock connecting system standardized by the ISO for International Container Shipping. The upper pile of the foundation system may have an industry produced twist-lock on a proprietary adjustable head.

Also, the building may include structural hanger/hold-down combination corners and intersection connectors that use the twist-lock and cast container corners. These connectors may house intersecting beam structures of the floor and create the base for the expanded structure. In another example, the structural elements under the SIPS floor panels may use a galvanized metal hanger system with through bolts in some areas.

Structural perpendicular or parallel beams supporting the outer structure may be connected to the container with metal hangers and use prefab notches and through bolts.

A rim/beam system and SIPS floor panels may have aligned pre-drilled holes running lengthwise in strategic locations. In one specific example, the first hole may be roughly 4 inches from the outer edge and another hole may be centered roughly 5 feet 6 inches out from the container, over the bearing beam system running lengthwise with the container. After the rim is placed around the perimeter of the extended structure, eyebolts with a flat head hexagon socket sleeve barrel nut may be pushed into predrilled holes from the outside of the exterior rim-R1. The eyebolt may align with the outer predrilled hole in the rim-R1 and floor panels. A threaded rod may be pushed through the holes in rim-R2 and through sleeve barrel nut eyebolts. On the push end of the rod may be a T that may be embedded into the outer edge of rim R2 to prevent rod from spinning. On the opposing end of the rod, another sleeve barrel nut may be pushed through opposite R2 and threaded onto the rod. The sleeve barrel nut may be tightened onto the threaded rod using a supplied oversized Allen wrench to press the floor panel splines together, ensure long term integrity and tie the rim and floor panels together for structural strength.

Further, a fabricated galvanized hanger may loop around exterior rim R1 and connect to a turnbuckle that extends into the lower portion of exterior wall.

In one specific example, a rim/beam structure may include a 3.5×11.25 Parallam (or other manufactured lumber product) and have a bearing notch cut out that may equal ½ the thickness (about 1.75 inches) by half the depth (about 5.5 inches). A center beam may be a 3.5×11.25 Parallam and may have a bearing 0.75 inch notch cut into each side of the beam the same depth. The resulting bearing ledge accommodates the 4.5 inch SIPS floor panels and may have roughly 1 inch of beam protruding above floor level. The resulting beam protrusion may serve as the lower track for the exterior SIPS wall base to align into.

In some cases, specialized SIPS panels form the walls and are made with a complete outside perimeter of Timberstrand, microlam, or other manufactured lumber product. In some of these examples, the resulting wall is 3.25 inches thick including a 1.75 inches central core sandwiched by two 0.43 sheets of sheathing, and exterior cementious paneling and reinforced interior fiberglass or composite wall panel make up the remaining layers. Beam pockets may be created for the bearing beams based at least in part on span and loading. Additional manufactured lumber product may be placed inside the wall for bearing under beams, window headers, or other engineered loads. Continuous aligned ¾ inch holes may be drilled in the upper and lower sections of wall panels. A corresponding aligned hole may be drilled into beams that are placed in wall pockets. After walls are placed, turnbuckles may be placed into predrilled holes in top of the wall for later use to secure the roof with the lower eyebolt aligned with the continuous hole. A threaded rod may be pushed through the aligned holes in the wall, through the lower turnbuckle eyebolt and the corresponding predrilled beam in wall pocket. The same procedure using an opposing T and sleeve barrel nut may be used to squeeze the wall splines, secure the beam, and secure the roof turnbuckles for future use. A lower threaded rod may be pushed through the lower wall hole, the outer rim/beam lower turnbuckles and secured as described above. When the threaded rod is parallel with the container length, the T/sleeve barrel nut system may be used. When the rod is transverse with the container, a sleeve barrel nut may be used on one end and an embedded welded nut into the container wall may be used on the other.

The roof panels may be placed over the roof beam structure and rest on the outer wall. Holes may be predrilled several inches back from each end of the roof panels and in the center over bearing. The same T/sleeve barrel nut system may be used to squeeze together the panel splines, secure them to the turnbuckles, and maintain the aligned structural integrity. Caps may be locked over the raised seamed roof panels joints to maintain a water tight application that secures the raised-seamed roofing panels together. Turnbuckles may have a hexagonal barrel core to allow tightening with a supplied wrench until the walls are secured to the rim and roof.

In some cases, when wall or floor panels intersect with container core, an embedded welded nut into the container wall may be used in conjunction with the threaded rod where application permits. At least some of the connections creating the outer climate shell have gaskets to help maintain minimal air infiltration. Rebar or other solid metal rod with welded threads and sleeve barrel nut may be used in lieu of threaded rod, if economically and structurally beneficial. Walls with door openings may create a break and require a modified application for the lower connecting rod. The upper and lower connecting rod may clear at least some window installations. An integrated drip edge-fascia system may be placed under the unfastened, outer edge of the raised seamed roofing to finish the exterior of the roof overhang. A gutter system may be integrated on the lower outer edges to facilitate water collection.

In some embodiments, the connections require no power tools. For example, many of the connections include threaded connections combined with lock-in splines, through rods, and connecting elements. These connections can be permanent, but can also be disassembled and require no power tools.

Joists and/or beams may be made from engineered lumber, composite, or metal depending on required structural application and/or environmental factors. They may be precut to length and prepared to install in particular model of structure. In some cases, the joist may contain holes or sleeved holes to bolt to the container core, bolt together, bolt to the floor panels and bolt to the wall panels. Corner bracing may have integrated twist lock (common in shipping industry) female connections and bolt holes to connect with joists, wall and floor panels. Joists may be pre-drill to accommodate turnbuckles installed horizontally into floor panels after floor is installed. The eyelet will align with the rod channel in the floor system. After floor is installed, threaded rod will extend through channel and turnbuckle eyelets. Then rod can be used to synch floor panels and joists together and turnbuckles can be synched to complete connection to joists. Floor joists may have interim holes drilled, to align with additional more central rod channels. These channels will use only a threaded rod and barrel nuts to synch together the components. Joists may have sleeves for turnbuckles to extend vertically into bottom of wall. The top metal eyelet will align with the bottom rod channel in the wall. The threaded rod will extend through the series of segmented wall sections and through the top eyelet of the joist turnbuckles. Turnbuckles can then be tightened to secure wall to joist and floor system The wall sections may set and slide together with a vertical channel created by extending the shear sheeting of the SIPS panel and recessing the panels on the opposite side. The wall panels may slide together and contain integrated gaskets to seal together. Wall panels may have predrilled rod channels in the top and bottom. Strategically placed to allow a threaded rod to be inserted through all wall panels, and aligned turnbuckles, after install. A combination of threaded nuts and/or isolation hooks will be used to synch all the walls together. The tensioned threaded rod may be used to allow the turnbuckles on bottom (with joist system) and top (with roof system), to be synched and complete the connection. In some cases, the wall corners have integrated connection depending on application. For instance, outer wall parallel with container outer panel may extend over the outside of a perpendicular wall end. A treaded rod may then extend through the edge of the parallel wall and continues through the wall channel of the perpendicular wall into the fixed net in the container wall. The system of wall panels may then secured together and to the container core.

The roof panels may use similar threaded rods, secure nuts, barrel nuts and turnbuckle systems. Turnbuckles may be installed in the top of wall panes after they are place on the floor system. The turnbuckle bottom eyelet may align with the top rod channel in the wall panes system and a threaded rod is then extended through the entire wall and lower eyelets. The rod is then secured with the barrel nut or other required connection, depending on application. The turnbuckles may be secured by the top wall rod extend into the roof panels as they are installed later. A subsequent threaded rod may be installed through the rod channel directly above the wall and aligned eyelets. Rod is secured by barrel nuts and then the turnbuckles are synched to secure the roof system to the wall system. Interim rod channels may be provided to further secure roof panels depending on overall span, interim bearing beam requirements, etc.

Joists, wall panels, and roof panels may secured to the container core with threaded rod or bolts. In some cases, a threaded rod, secured nut or hook, and barrel nuts are used to secure panels perpendicular to a sidewall. The rod is extended through installed wall panels and threaded into a nut pre-welded and placed in container core outer panel. A barrel nut is used to synch wall panels together and secure the wall to the container

Safety Features

As mentioned above, the intermodal container may form a safety pod when the building in completed. The safety pod may have a higher structural integrity than the rest of the building that can withstand forces that are likely to occur during natural disasters and violent situations. Further, the safety pod may be a more secure area where valuables, pharmaceuticals, and other items can be safely stored.

While the intermodal container may be modified with passages, the structural integrity of the container can be retained. Exterior overhead storm doors can be strategically cut and welded into place. These exterior doors, in the side of the unit, allow access to the building materials and later become passageways that coordinate with the finished floor plan. The original swing doors on the end of the container are closed and covered as the project concludes, if the structure is a standalone application, to preserve the core strength of the container. The original swing doors may be left open for multiple container applications.

In some cases of remote structures worldwide, modular or not, security is an issue. In the case of hospitals and clinics, additional security concerns may arise because of the valuable equipment and controlled pharmaceuticals. In the case of remote cabins, valuable furnishings are commonly damaged or stolen by trespassers or wildlife. The buildings retain the convenient lockable overhead storm doors to allow for secure safety pod lock-up when the structures are unattended.

The glass in windows and doors may be laminated to guard against breakage and reduce dangerous shards in the event of a direct strike. Movable joints and unified strength through the paneled system may provide great protection from earthquake and high winds. The structural integrity and proprietary integrated fastening system of the outer walls may give enhanced protection. The encapsulating walls and central core are firmly secured to the ground in multiple places and any catastrophic event may have to tear the walls completely apart to compromise the exterior shell.

The structural integrity of the intermodal container may provide the building's highest level of protection. The intermodal container may be an extremely strong structure that has been time tested in the harshest environments on earth. Single level units may have the central core connected at least every 10 feet with the industry standard twist-locks. The pile foundation system may hold until the connections shear. In examples where the intermodal container is an ISO rated containers, the intermodal container meets a rigorous set of standards certified regularly by the Convention for Safe Containers. These standards render the shipping container a formidable fortress of protection. These standards should protect occupant through a sustained Category 4 Hurricane that rips most framed structures apart. It is likely that one could survive a Category 5 inside the safety pod. A tornado may be the most destructive wind event on earth. The destruction through the tornado belt in the United States is devastating for any modular home or trailer. Generally, just a concrete slab and some debris are usually all that is left in the aftermath of a F2 rated tornado. The building may be constructed so that a child, with the stature of a 5 year old, should be able to reach the safety doors and lock them if they are alone and hear a tornado warning. If all the outer structure is blown away, the container core could still protects them and holds firm.

Rigid and brittle structures are vulnerability during an earthquake. The outer SIPS walls, seamed together as panels through the integrated connection system may allow for some flex and give. Their gasket seams allow for a great deal of flex without significant damage or loss of integrity. In the unlikely event that an earthquake damages the outer walls, the container's safety pod remains essentially indestructible.

The outer shell may be built of solid material and may generally have noncombustible exterior finishes, like a metal roof and cement siding, unless a custom order requests an alternative. Exterior finish materials that can be enduring and provide a high level of safety from combustibility may be used in the building's construction. The container core may provide some additional level of protection for furnishings in the event the outer walls were compromised.

In many areas of the world, organized public protection may be limited and the innocent and defenseless are harmed through senseless violence. The building described herein provides safety where families can lock down a home, medical personnel can lock a clinic, or some teachers and kids may be saved if one of our schools has a chance to lock down their doors in the face of this kind of threat.

Power Management System

The building may include an off-grid energy management system. This system may include solar power and LED lighting. For example, the solar power may have durable power management, storage, and multiple voltage dissemination, and the LED lighting may dissipate heat build-up to sustain estimated extended life cycle.

Also, the buildings may be pre-wired for exterior utility connections for established infrastructure. The building may have stubs for permanent utility hookups for current or future infrastructure. In the event, some humanitarian units are sent to undeveloped regions with minimal chance of infrastructure development, alternate finish packages of exterior accommodations may be considered to allow for potential contingencies, like occasional supplement generator power.

In some examples, solar panels may be pre-fastened to the roof panels. The assembler may have the option to set the solar panels on whatever side of the roof that is most productive for generation. At least some of the connections may be specialized quick connections. Power management and storage may be cabinet mounted for safety and convenience. An inverter may allow for several 120 volt outlets, prewired and located in the core container so no high voltage wiring may be required by the assembler.

In some examples, the central container core may have inverted 120 volt wiring complete, including some GFCI outlets in the kitchen and bath and legally required wall outlets in the common area. At least some lighting installed to serve the kitchen, bath, and other areas in the container core may be 24 volt LED. The peripheral rooms may also have 24 volt lighting with the switches wired in the main container and switched leads in specific locations for future connection as the roof panels are installed. The wiring connections, for the assembler to complete, may be 24 volt and may be specialized quick connecters for safety, simplicity, durability, and re-use. At least some units may use newly engineered lighting that uses small LEDs, spaced in flush circular fixtures to create maximum light with minimal heat. The new fixtures magnify each small LED with a lens, manage power consumption for even light, and keep cool to maintain the estimated 20+ year lifespan. At least some units may follow this basic outline of several prewired inverted plugs in the central core and peripheral 24 volt lighting.

When the buildings are installed in the United States, Europe, and other developed countries, additional electrical features and elements can be included to meet the requirements for International Building Code approval. Additional 120 volt outlets are required in the peripheral rooms. A wired baseboard may allow for adequate outlets in each room to satisfy code approval. The wired baseboard may be a 12 inch by 1.5 inch composite board with installed outlets, in shallow boxes, prior to the wired baseboard being installed in each room. The base may be specifically precut for each room and the appropriate outlets are then spaced and fully wired with cover plates. The base may be reverse folded on itself and packed during transport and later to be clipped in place during installation. This may require a few 120 volt quick connects. Female connections may be installed and waterproof plugged in the side of the containers where a future wired baseboard may terminate. Re-usable connectors may facilitate an easy clip-in install around the perimeter of each room.

In some examples, the building includes a wall, a baseboard selectively removable from the wall, a pre-fold formed in the baseboard, a wire embedded in the baseboard and traversing the pre-fold, and an electrical outlet incorporated into the baseboard and in communication with the wire. A connector may be attached to the wall, and the baseboard may be detachably connected to the wall through the connector. In some cases, the connector is a clip. A board electrical connector incorporated into the board may be in communication with the wire, and a wall electrical connector may be incorporated into the wall. The wall electrical connector and the board electrical connector may form an electrical connection when the wall electrical connector and the board electrical connector are attached. In those examples where the building includes solar panels, the solar panels may be in electrical contact with the wall electrical connector.

The baseboard may be made of any appropriate material thick enough to contain an approved outlet box and resilient enough to satisfy the code requirements for wiring protection. Some material may require conduit in the wire channel. Wire may be run inside a routed channel that may or may not require a conduit casing. Outlets may be completely made up, with finished cover plate, to avoid any required technical interaction by unskilled labor. Outlets may be installed vertically or horizontally and can be put at any level off the floor required be International Building Code or local municipal code requirements.

The wiring may terminate in a box containing an outlet on end farthest from connection. The wiring may connect to main building in approved power box. In some cases, the connection to main building may be with one of several approved, re-usable quick connectors.

The baseboard may be fully wired and then reverse folded onto itself for minimal space requirement during shipping. The wiring may retract from the connection end several inches to accommodate the folding process. After the baseboard is unfolded and placed on site, the slack wire is then pulled into place and connected in the integrated connection box. The baseboard may be installed to wall with integrated, re-usable plunge connectors or fasteners screwed through the base from finished side

Water Management System

In some examples, the building includes a water management system. This system may include gathering water from rain fall. Gutter water collection may include multiple cisterns, a grated gutter guard and distribution, a debris collection, a roof wash diverter system, a lower cistern for storage, a level check and supplement water access, an upper cistern for security and gravity flow, and a purification system. Further, a septic system may include a tank, drain field, and a supplement bedding. At least some of the tanks are nested together to minimize storage area demands during transport. Further, the buildings may include waterless or low flow plumbing fixtures and the highest efficiency in available electrical appliances and furnishings.

A gutter may be integrated with a grid that prevents debris from entering the gutter. In one example, a 680 square foot roof can collect roughly 400 gallons of water for every inch of rainfall. A roof wash system automatically allows for several gallons of water to initially wash the roof before the water is diverted to the collecting cistern. The gridded gutter, multiple-cistern water collection system allows for debris removal, silt management, and filter cleaning.

Multiple cisterns may be used. One can be an in-ground cistern and another cistern can be a roof mounted cistern provided for convenience, efficiency, and increased flexibility. Each cistern, in one example, may be roughly 750 gallons and can be covered and accessed through a top-mounted access hatch. A total of 1500 gallons can be captured and saved from almost 4 inches of rainfall. The ground level cistern may be dug into the ground 3-4 feet and has a secure access door to reach above grade. The ground cistern allows for freeze protection, ground level inspection, and ground level water supplementation during dry seasons.

The roof cistern can be placed on top of the container and then covered with the upper roof. An access panel can be incorporated into the back wall near the cistern. The upper cistern can be encapsulated inside the building envelope which may protect it from damage, help prevent freezing, warm the water during the summer, and provide for gravity fed pressure.

The upper cistern may have the ability to be filled by a DC pump that is fed from the solar array. The same pump may pressurize the entire water system with a manual diverter valve. A backup foot-pump may be integrated into a wall panel for alternate filling of the upper cistern. The upper cistern be used for at least some grey water needs and showering.

Water purification may be limited to drinking water to minimize the maintenance requirements for the system, but in some cases, the entire system may include a water purification mechanism. This can be accomplished with a simple 2-stage cartridge system located below the kitchen sink. An alternate faucet may be fed from the purification system into the sink for drinking and other culinary uses. Purifying the entire upper cistern may be an option.

The septic system may use a tank with the same basic shape as the water cisterns to facilitate nesting. This tank can be made from a different material and may have a taller access tube to allow for deeper burial. The septic system has a small, three tube drain field that may be connected to the septic tank and dug in by hand. The tub/shower may be packed with bags of drain gravel during transit that may be the first level of bedding to supplement granular native materials.

Climate Control

In some cases, the building includes climate control options. In those examples that include insulated panels, the interior of the building may be insulated from the building's ambient outside environment. Thus, the temperature inside the building may involve less energy to maintain a desirable temperature for occupants. In examples where the building has access to the power grid, a wall mounted unit with ducting above the ceiling in the central container may be used.

In other cases, such as those cases where the building is off the power grid, a wood burning cook-stove may be used. Such a stove may be supplied with the appropriate pre-installed combustible barriers in the designated location and exhaust pipe with a flashed access hole in the designated roof panel.

Finished Building

While the examples above have been described with specific dimensions, the building may include any appropriate dimensions. For example, the expandable wall system includes flexibility and allows for numerous size variations and applications for multiple units. In one example, single level units range from a starter unit at roughly 270 square feet. A 20 feet units may expand to 640 square feet, 30 feet units to 950 square feet, and 40 feet single levels that expand to 1280 square feet. In other examples, multiple single-level units can be joined for an endless footprint of additional footage and/or the additional space to supply equipment and furnishings. Other examples may include multiple levels with core containers and expandable structures stacked on top of each other.

In some specific examples of the building include a 40 feet 1280 square feet building for a schoolhouse, dorm, or hospital; a 20 feet Cottage with a craftsman, country French and contemporary exteriors; multiple interconnected 20 feet containers with larger footprint and/or furnishing packages for home and clinic applications; a combination 40 feet/20 feet building with a single level configurations; a combination 40 feet/20 feet multi-level homes in several exterior themes and configurations; multi-level configurations of one or multiple size containers for apartment and multifamily applications; multiple 40 feet single level combinations for group housing, dorms, barracks, etc.; other applications; or combinations thereof.

In some cases, the buildings may include multiple unit structures that can be locked together but not use at least some of the available packing space for panels. In these examples, some packing room in the additional containers can be reserved for SIPS panels that may increase footage in the final floor plan with the remainder of the packing area dedicated to equipment and furnishings. The addition of a second unit can make more space available, as a stand-alone unit needs every square inch of space to supply the required elements for a complete structure. The multiple unit embodiments can be used for getting additional supplies to remote areas especially for remote school where desks, books and other equipment would be particularly useful, especially for humanitarian projects where equipment and furnishings are not available. Also, the multiple unit embodiments can be useful for medical clinics where the additional space can be used for equipment, beds, instruments, medicine, etc. Additionally, the extra space can be used for remote cabins that need items like beds, tables, chairs, wood stoves, or other appliances.

What is claimed is:

1. A kit for constructing a building, comprising:

an intermodal container, the intermodal container including:

four exterior walls forming a perimeter of the intermodal container;

a floor connected to each of the four exterior walls;

a roof connected to each of the four exterior walls; and wherein the four exterior walls, the floor, and the roof collectively define an interior volume of the intermodal container;

a plurality of structural building components disposed within the interior volume;

wherein when the building is constructed with the structural building components, at least one of the four exterior walls of the intermodal container is repurposed as an interior wall of the building;

wherein at least one foundation pile is disposed within the interior volume;

wherein the foundation pile is configured to attached to a corner fitting of the intermodal container; and wherein the intermodal container forms a safety pod in a middle of the building when the building is constructed, the safety pod having the characteristic of greater stability to withstand a force of nature than other rooms in the building.

2. The kit of claim 1, wherein the structural building components include all the structural elements necessary to construct the building.

3. The kit of claim 1, wherein the structural building components includes detachable walls that form exterior building walls when the building is constructed.

4. The kit of claim 1, wherein at least a portion of the plurality of structural building components is configured to attached to includes at least one foundation pile includes a height adjustable portion.

5. The kit of claim 1, wherein at least a portion of the plurality of structural building components is configured to be attached to includes an adjustable pile foundation system and/or the intermodal container.

6. The kit of claim 1, further including a pre-wired base board.

7. A packaged intermodal container, comprising:

four exterior walls forming a perimeter of the intermodal container;

a floor connected to each of the four exterior walls;

a roof connected to each of the four exterior walls;

the four exterior walls, the floor, and the roof collectively forming an interior volume of the intermodal container;

all the structural elements necessary to construct a building disposed within the interior volume;

wherein when building is constructed with the structural elements, at least one of the four exterior walls is repurposed as an interior wall of the building;

wherein at least one foundation pile is disposed within the interior volume;

wherein the foundation pile is configured to attached to a corner fitting of the intermodal container; and wherein the intermodal container forms a safety pod having the characteristic of greater stability to withstand a force of nature than other rooms in the building.

8. The packaged shipping container of claim 7, wherein all the tools necessary for constructing the building are disposed within the interior volume.

9. The packaged shipping container of claim 7, wherein when the building is constructed, at least one of the exterior walls are repurposed as interior walls of the building.

10. The packaged shipping container of claim 7, wherein the intermodal container is repurposed as part of the building.

11. The packaged shipping container of claim 7, wherein the intermodal container forms one of multiple rooms of the building.

12. The kit of claim 7, wherein the at least one foundation pile includes a height adjustable portion.

13. The kit of claim 7, wherein at least a portion of the plurality of structural building components is configured to attached to an adjustable pile foundation system and/or the intermodal container.

* * * * *